United States Patent [19]

Kishi

[11] Patent Number: 4,691,805

[45] Date of Patent: Sep. 8, 1987

[54] LIFTING APPARATUS

[75] Inventor: Mitsuihiro Kishi, Ashikaga, Japan

[73] Assignee: Kabushiki Kaisha Hikoma Seisakucho, Ashikaga, Japan

[21] Appl. No.: 845,687

[22] Filed: Mar. 28, 1986

[30] Foreign Application Priority Data

| | | | |
|---|---|---|---|
| Mar. 28, 1985 | [JP] | Japan | 60-064803 |
| Jul. 26, 1985 | [JP] | Japan | 60-166577 |
| Sep. 19, 1985 | [JP] | Japan | 60-207155 |
| Sep. 19, 1985 | [JP] | Japan | 60-207156 |

[51] Int. Cl.[4] ..... B66B 9/20

[52] U.S. Cl. ..... 187/9 R; 182/2; 212/267

[58] Field of Search ..... 187/9 R, 9 E, 17, 18, 187/8.71; 182/141, 2, 63; 52/118, 119, 116, 121; 212/267, 261, 255, 256

[56] References Cited

U.S. PATENT DOCUMENTS 4,296,833 10/1981 Ashworth ..... 182/2

FOREIGN PATENT DOCUMENTS 58-36900 3/1983 Japan .
58-95100 6/1983 Japan .
163430 12/1985 Japan ..... 182/2
61-221100 10/1986 Japan .

*Primary Examiner*—Joseph J. Rolla
*Assistant Examiner*—Kenneth Noland
*Attorney, Agent, or Firm*—Wenderoth, Lind & Ponack

[57] ABSTRACT

A lifting apparatus comprises a mobile vehicle, a platform disposed above the mobile vehicle, a single telescopic stretchable boom pivotally joined at the lower end with a pin to the mobile vehicle and at the upper end with a pin to the platform, and a hydraulic control system comprising a control circuit and a hydraulic circuit. The control circuit controls the hydraulic circuit according to detection signals given thereto from an extension detecting unit for detecting the extension of the stretchable boom and an inclination detector for detecting the inclination of the stretchable boom so that the platform is raised or lowered vertically and shifted horizontally on an elevated level through the manual control or automatic control of the control circuit or so that the platform is moved obliquely between the original position and a desired oblique position with respect to the mobile vehicle through the automatic control operation of the control circuit on the bases of recorded information relating to the oblique position. The control circuit also controls the hydraulic circuit so that the platform is always held in parallel to the upper surface of the deck of the mobile vehicle during the platform moving operation.

29 Claims, 2 Drawing Figures

LIFTING APPARATUS

BACKGROUND OF THE INVENTION

1. Field of the Invention

The present invention relates to a lifting apparatus capable of conveying persons and/or goods from or to different levels by raising a platform from a vehicle and, more particularly, to a lifting apparatus capable of raising a platform to a level and horizontally moving the platform on the level stored in a memory or repeatedly raising the platform to the level stored in the memory.

2. Description of the Prior Art

Lifting apparatus capable of conveying persons and goods from or to different levels by raising or lowering a platform are used widely for assembling work, painting work or repairing work at a high level on expressways and building construction sites. The typical conventional lifting apparatus employs an telescopic pantograph mechanism, namely, a so-called scissors type linkwork, comprising a plurality of pairs of arms each having pair of arms pivotally joined at the middle. In order to increase the maximum lift of such a lifting apparatus, it is necessay to increase the length of the arms or to increase the number of the pairs of arms. Accordingly, such a lifting apparatus having a large lift needs a pantograph mechanism consisting of many links. Therefore, the lifting platform of the lifting apparatus is located at a high level even when the pantograph mechanism is collapsed, and hence it is difficult for persons to get on and off the platfrom and it is troublesome to load and unload the platform.

Lifting apparatus having a single stretchable arm comprising a plurality of telescopically combined booms have been proposed in Japanese Patent Application Nos. 56-134487 and 56-191065.

All those newly proposed lifting apparatus, however, inevitably need an increased number of booms, and hence so many components are necessary, troublesome manufacturing and assembling work is required and the lifting appatatus are expensive. Furthermore, those lifting appatus have so many sliding parts for assembling the booms and arms. Since those sliding parts are provided with sliding members, such as MC nylon members, so many parts need to be replaced periodically requiring large inspection and maintenance costs and troublesome work.

Another lifting appatus has been disclosed in Japanese Patent Application No. 60-64803. This lifting apparatus has a single stretchable boom mounted on a vehicle for lifting a platform. This lifting apparatus has a simple constitution and facilitates the inspection and manufacture thereof. However, in this lifting apparatus, dexterous operation is required for stably moving the platform in a horizontal direction at an elevated level and it is very difficult to lift the platform repeatedly to a fixed elevated position.

Accordingly, it is an object of the present invention to provide a lifting apparatus having a single stretchable boom and simple constitution, facilitating manufature and inspection, and capable of smoothly raising or lowering the platform through the electronic control of the platform lifting operation.

It is another object of the present invention to provide a lifting apparatus capable of smoothly and vertically moving the platform.

It is a further object of the present invention to provide a lifting apparatus capable of smoothly and horizontally moving the platform at an elevated level.

It is a still further object of the present invention to provide a lifting apparatus capable of storing the data of a desired elevated position in a memory and automatically and repeatedly moving the platform between a reference level and the desired elevated position corresponding to the data stored in the memory.

According to one aspect of the present invention, there is provided a lifting apparatus comprising: a mobile vehicle; stretchable boom consisting of a plurality of booms inserted one in another in telescopic fashion and pivotally supported on the mobile vehicle; a platform pivotally joined to the free end of the stretchable boom; extension detecting means for detecting the working length of the stretchable boom; inclination detecting means for detecting the inclination of the stretchable boom with respect to a reference plane; and hydraulic control system for controlling the strechable boom on the basis of signals given thereto by the exenstion detecting means and the inclination detecting means wherein the stretchable boom is controlled so that the platform is raised vertically.

According to another aspect of the present invention, there is provided a lifting apparatus comprising: a mobile vehicle; a stretchable boom consisting of a plurality of booms inserted one in another in telescopic fashion and pivotally joined to the free end of the stretchable boom; extension detecting means for detecting the working length of the stretchable boom; inclination detecting means for detecting the inclination of the stretchable boom with respect to a reference plane; and a hydraulic control system for controlling the stretchable boom on the basis of signals give thereto by the extension detecting means and the inclination detecting means so that the platform is raised vertically and is moved horizontally at an elevated level.

According to a further aspect of the present invention, there is provided a lifting apparatus comprising: a mobile vehicle; a stretchable boom consisting of a plurality of booms inserted one in another in telescopic fashion and pivotally supported on the mobile vehicle; a platform pivotally joined to the free end of the stretchable boom; extension detecting means for detecting the working length of the stretchable boom; inclination detecting means for detecting the inclination of the stretchable boom with respect to a reference plane; an electronic control system; and a hydraulic control system for controlling the stretchable boom on the basis of signals given thereto by the extension detecting means and the inclination detecting means and also on the basis of data regarding a position of the platform stored in the memory of the electronic control system, wherein the platform can be raised vertically through manual or automatic operation, the platform can be moved horizontally at an elevated level through manual or automatic operation, and the platform can be moved repeatedly and automatically between a reference position and a desired elevated position stored in the momory of the electronic control system.

The lifting apparatus according to the present invention is constituted on the basis of the following principle, which will be described hereinafter with reference to FIGS. 11 and 12.

Referring to FIG. 11, a stretchable boom T consists of a first boom P, a second boom Q, a third boom R and a cover members S which are connected telescopically so as to be slidable relative to the adjacent booms. The first boom P is joined pivotally at the lower end thereof with a pin O to a pair of brackets N fixed to the upper surface of a vehicle M serving as the base. A platform V is joined pivotally with a pin W to the upper end of the cover member S. When the stretchable boom T is extended to a length Ln (n=an optional integer), the inclination $\theta n$ of the stretchable boom T is regulated so as to meet $$Ln \cdot \cos \theta n = (C = \text{a constant}) \quad (1)$$

For example, when $L1 \cdot \cos \theta 1 = L2 \sqrt{\cos \theta 2} = L3 \cdot \cos \theta 3 = C$, the horizontal distance beetween the center of the pin O and the center of the pin W is always C, while the vertical distances between a reference plane including the center of the pin O and the center of the pin W are H1, H2 and H3, spectively. Accordingly, the platform V is raised vertically.

Principle for horizontally moving the platform V on a fixed elevated level will be described with reference to FIG. 12. According to this principle, the distance Lm between the center of the pin O and the center of the pin W, and the inclination $\theta m$ (m=an optinal integer) of the stretchable boom T are regulated so that $$Lm \cdot \sin \theta m = H \ (H = \text{a constant}) \quad (2)$$

For example, when $L1 \cdot \sin \theta 1 = L2 \cdot \sin \theta 2 = H$, the vertical distance between the center of the pin W and the reference plane is always H, while the horizontal distances between the center of the pin O and the center of the pin W are C1 and C2, respectively. Accordingly, the platform V is moved horizontally on a fixed elevated level at a height H.

The above and other objects, features and advantages of the present invention will become more apparent from the following description accompanying drawings.

DESCRIPTION OF THE PREFERRED EMBODIMENTS

Figure 1:
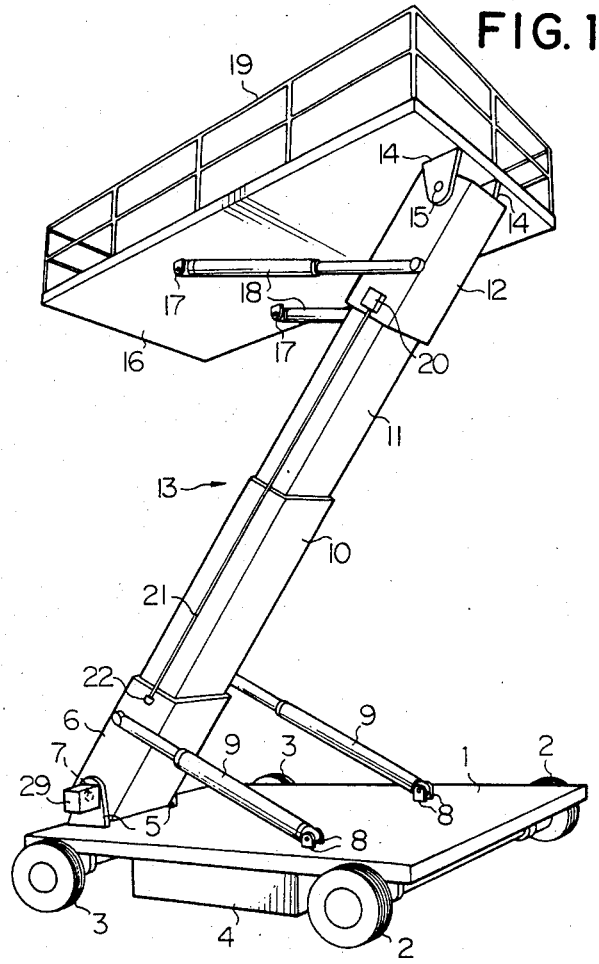
FIG. 1 is a perspective view of a lifting apparatus, in a first embodiment, according to the present invention.

The present invention will be described hereinafter with reference to preferred embodiments thereof in conjuction with the accompaying drawings in which like reference characters designate like or corresponding parts throughout.

A lifting apparatus, in a first embodiment, according to the present invention will be described with reference to FIGS. 1 to 10.

A mobile vehicle 1 has a pair of front wheels 2 and a pair of rear wheels 3. A power unit 4 including a engine, a hydraulic pump and the associated components is attached to the underside of the deck of the vehicle 1. A pair of pedestals 5 are fixed to one longitudinal end of the topside of the deck of the vehicle 1 at a space apat. A hollow first boom 6 having a rectangular cross section is joined pivotally to the pedestals 5 with a pin 7. A pair of clevises 8 are fixed to the other logitudinal end of the topside of the deck of the vehicle 1. A pair of hydraulic cylinders 9 for controlling the inclination of a stretchable boom 13 are joined pivotally at the respective opposite ends thereof to the clevises 8 and the first boom 6, respectively. A hollow second boom 10 having a rectangular cross section is slidably fitted in the hollow first boom 6, while a hollow third boom 11 having a rectangular cross section is fitted slidably in the second boom 10. The upper end of the third boom 11 is inserted in and fixed to the upper end of a fourth boom 12 having a rectangular cross section. A uniform clearance is formed between the outer circumference of the third boom 11 and the inner circumference of the fourth boom 12. The first boom 6 and the fourth boom 12 each has a length about the half of the length of the vehicle 1, while the second boom 10 and the third boom 11 each has practically the same length as the length of the vehicle 1. The strechable boom 13 comprises the first boom 6, the second boom 10, the third boom 11 and the fourth boom 12. Indicated at 16 is a platform having substatially the same floor area as the deck of the vehicle 1. A par of pedestals 14 are fixed at a space apart to one end of the underside of the platform 16. The upper end of the fourth boom 12 is disposed between the pedestals 14 and are joined pivotally to the pedestals 14 with a pin 15. A pair of clevises 17 are fixed to the other end of the underside of the platform 16. Hydraulic cylinders 18 are joined pivotally at the respective opposit ends to the clevises 17 and the fourth boom 12, respectively. A guardrail 19 is provided around the platform 16.

Figure 5:
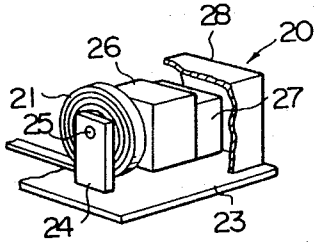
FIG. 5 is a perspective view of an extension detecting unit employed in the lifting apparatus of FIG. 1.

An extension detecting unit 20 is attached to one side of the fourth boom 12. The free end of a tape 21 extending from the extension detecting unit 20 is fixed to one side of the first boom 6 by means of a fixture 22. The tape 21 is drawn out or retracted into the extension detecting unit according to the extension or contraction of the strechable boom 13 to measure the extension of the stretchable boom 13. As best illustrated in FIG. 5, the extension detecting unit 20 comprises a base 23, a support 24, a shaft 25 rotatably supported on the support 24, the tape 21 wound on the shaft 25, a winding device 26 for winding up te tape 21, a digital encoder 21 and a cover 28 covering those components. The shaft 25 is coupled with the winding device 26 and the rotary shaft of the digital encoder 27.

An inclination detector 29 is fixed to the pedestal 5 with the detecting head thereof coupled with the pin 7. The inclination detector 29 detects the inclination of the stretchable boom 13 by means of a suitable sensor, such as a potentiometer, and provides a signal corresponding to the inclination of the stretchable boom 13.

Figure 6:
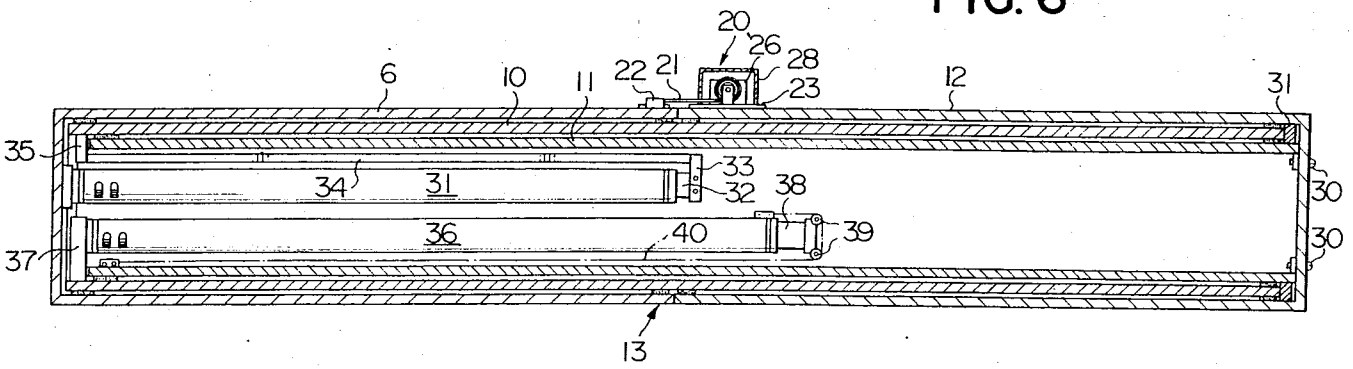
FIG. 6 is a sectional side elevation of a stretchable boom.

FIG. 6 illustrates the constitution of the stretchable boom 13. The first boom 6 and the fourth boom 12 each has the shape of a rectangular pipe having one closed end. The hollow rectangular second boom 10 having an external size slightly smaller than the internal size of the first boom 6 and the fourth boom 12 is inserted slidably in the first boom 6 and the fourth boom 12. The third boom 11 having an external size slightly smaller than the internal size of the second boom 10 is inserted slidably in the second boom 10. The third boom 11 is fastened at the upper end thereof to the upper end of the fourth boom 12 with bolts 30. The third boom 11 is hollow throughout the entire lengh thereof. A hydraulic cylinder 31 is disposed inside the third boom 22 so as to extend in parallel to the logitudinal axis of the third boom 11 with the base end there fixed to the first boom 6. An adapter 33 is fixed to the free end of the piston rod 32 of the hydraulic cylinder 31 so as to project perpendicularly to the longitudinal axis of the piston rod 33. A rod 34 extended in parallel to the piston rod 32 is fixed at one end thereof to the adapter 33 and at the other end thereof through a block 35 to the lower end of the second boom 10. A hydraulic cylinder 36 is disposed inside the third boom 11 with the base end thereof fixed to a block 37 fixed to the lower end of the second boom 10. Pulleys 39 are pivotally attached to the free end of the piston rod 38 of the hydraulic cylinder 36 and a wire 40 connected at one end to the hydraulic cylinder 36 and at the other end to the lower end of the third boom 11 is extended around the pulleys 39.

A spacer 41 having an external shape substantially the same as the internal shape of the fourth boom 12 and an internal shape substantially the same as the external shape of the third boom 11 is slidably fitted on the third boom 11 so as to be always in contact with the upper end of the second boom 10.

Figure 7:
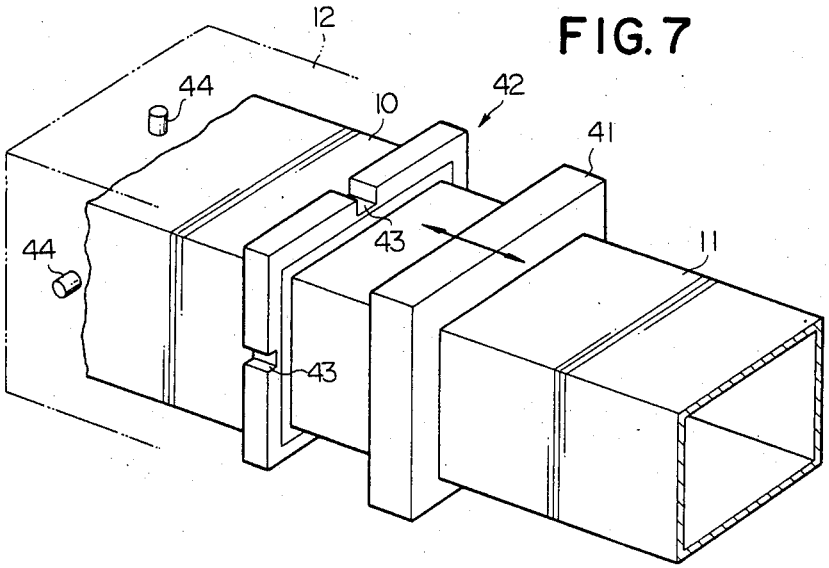
FIG. 7 is a fragmentary perspective view showing the lower end portion of the first boom and its vicinity of the stretchable boom of FIG. 6.
Figure 8:
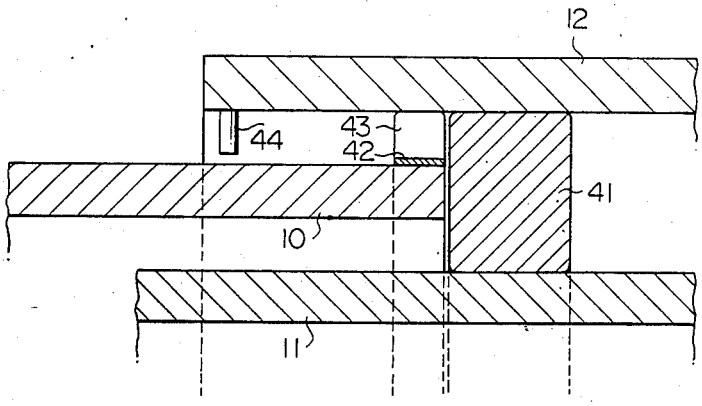
FIG. 8 is an enlarged fragmentary view of the lower end portion of the first boom and its vicinity of the stretchable boom of FIG. 6.

FIGS. 7 and 8 illustrate the configuration of the second boom 10, the upper end of the fourth boom 12 and the spacer 41. A frame-shaped slider 42 having an external shape substantially the same as the internal shape of the fourth boom 12 is fixedly fitted on the end of the second boom 10. A recess 43 is formed in the middle of each side of the slider 42. A stopping pin 44 projects inward with a clearance between the free end thereof and the second boom 10 from the middle of the inner surface of each side of the fourth boom 12 near the lower end of the same.

Figure 9:
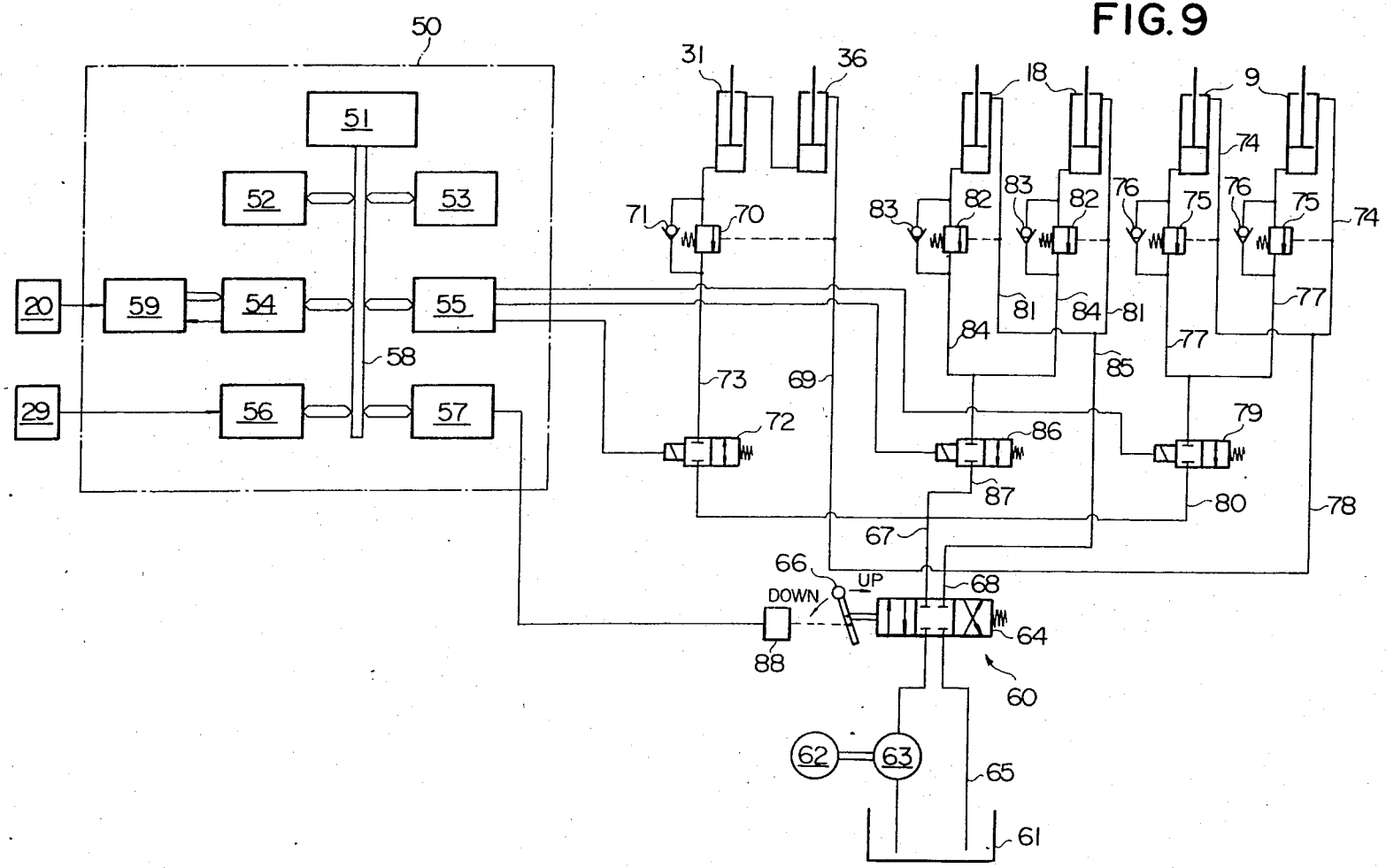
FIG. 9 is a hydraulic circuit diagram showing the constitution of a hydraulic control system emplyoed in the first embodiment of the present invention.
Figure 10:
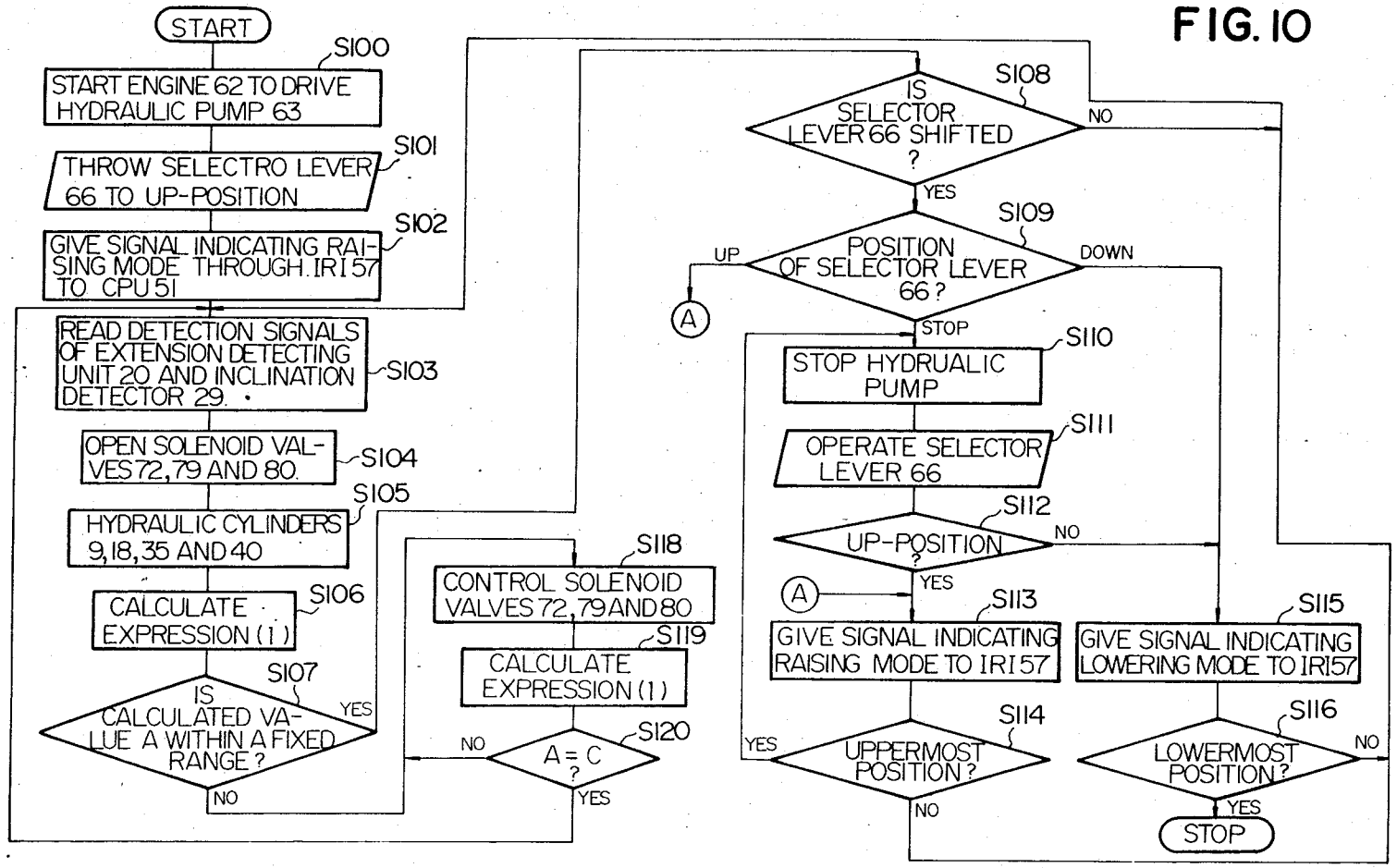
FIG. 10 is a flow chart of a control program for controlling the operation of the first embodiment of the present invention.
Figure 11:
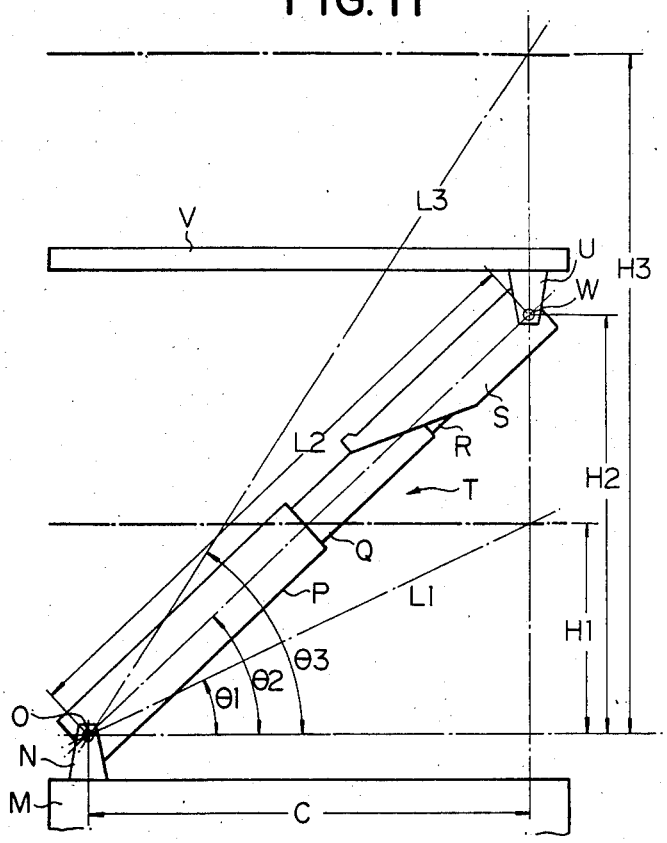
FIGS. 11 and 12 are diagramaic illustrations of assistance in explaining the principle of the present invention.

As best illustrated in FIG. 9, a hydraulic control system comprises a control circuit 50 and a hydraulic circuit 60.

The control circuit 50 is an electronic microcomputer comprising a central processing unit (hereinafter abbreviated to "CPU") 51 for processing data, a read-only memory (hereinafter abreviated to "ROM") 52 storing predetermined programs and constants, a random access memory (hereinafter abbreviated to "RAM") 53 storing programs to be executed and variable, a digital signal input-output device (hereinafter abbreviated to "DIO") 54 which receives digital signals, a digital signal output device (hereinafter abbreviated to "DO") 55 which sends out digital signals, an analog-to-digital converter (hereinafter abbreviated to "ADC") 56 which converts analog signals into the corresponding digital signals, an interrupt input device (hereinafter abbreviated to "IRI") 57 which receives interrupt signals, bus lines 58 interconnecting those devices, and a counter 59 connected to the DIO 54. The extension detecting unit 20 is connected to the counter 59; the inclination detector 29 is connected to the ADC 56; a driving sensor 88, which will be described later, is connected to the IRI 57; and solenoid valves 72, 79 and 86 are connected to the do 55.

In the hydraulic circuit 60, a hydraulic pump 63 which is driven by an engine 62 sucks working fluid from a reservoir 61 and discharges pressurized working fluid to the circuit through a selector valve 64. A return pipe 65 is connected to the selector valve 64 to return the working fluid to the reservoir 61. The selector valve 64 is controlled with a selector lever 66 to supply the pressurized workig fluid to either a line 67 or a line 68.

Hydraulic cylinders 31 and 36 are connected in series. The hydraulic cylinder 31 is connected through a parallel circuit of a pressure regulating valve 70 and a check valve 71, a line 73 and a solenoid valve 72 to the line 67, while the hydraulic cylinder 36 is connected through a line 69 to the line 68. A pair of circuits each consisting of hydraulic cylinders 9 and a parallel connection of a pressure regulating valve 75 and a check valve 76 are connected in parallel to a line 74 and to a line 77. The line 74 is connected through a line 78 to the line 68, while the line 77 is connected through a line 80 to the line 67. A pair of circuits each consisting of a hydraulic cylinders 18 and a parallel connection of a pressure regulating valve 82 and a check valve 83 are connected in parallel to a line 81 and to a line 84. The line 81 is connected through a line 85 to the line 68, while the line 84 is connected through a line 87 provided with a solenoid vave 86 to the line 67. The driving sensor 88 isconnected to the selector lever 66 to detect the three positions of the selector valve 64, namely, a STOP-position, an UP-position and a DOWN-position.

The manner of operation of the first embodiment will be described hereinafter with reference to FIGS. 1 to 10.

Figure 2:
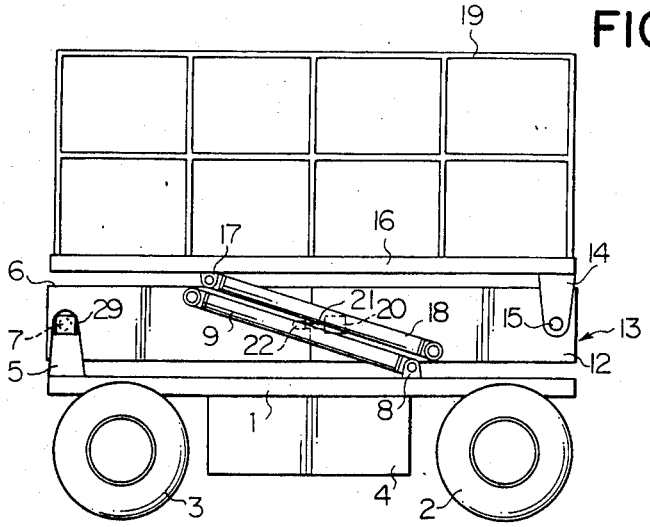
FIG. 2 is a side elevation of the lifting apparatus of FIG. 1, in which the platform is lowered to the lowermost position.
Figure 3:
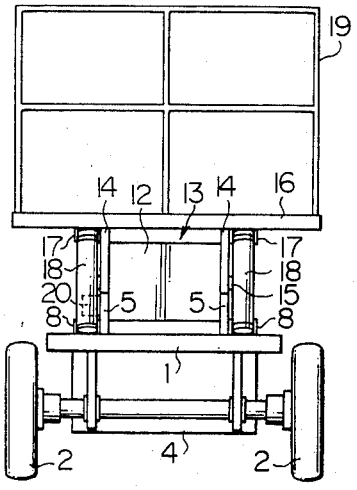
FIG. 3 is a front elevation of the lifting apparatus of FIG. 1.
Figure 4:
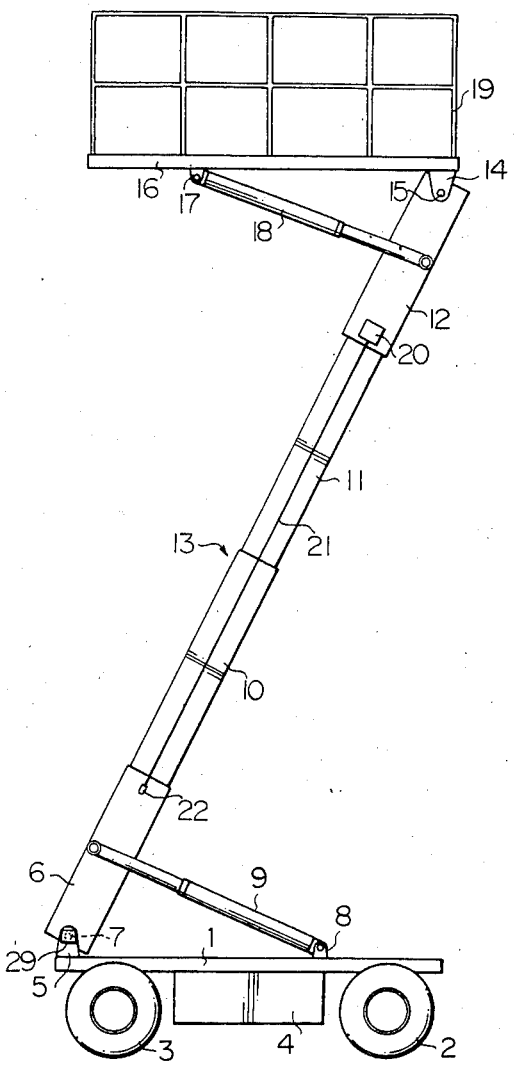
FIG. 4 is a side elevation of the lifting apparatus of FIG. 1, in which the platform is raised to the uppermost position.

With the stretchable boom 13 contracted to place the platform 16 at the lowermost position as illustrated in FIGS. 2 and 3, a person gets on the platform 16 and/or materials are put on the platform 16. Then, the hydraulic pump 63 is driven by the engine 62 of the power unit 4 to discharge the pressurized working fluid to the hydraulic circuit 60 (step S100) and the selector lever 66 is shifted to the UP-position (step S101). The driving sensor 88 detects the shift of the selector lever 66 to the UP-position and gives a signal indicating the lifting operation of the hydraulic circuit 60 through the IRI 57 to the CPU 51 (step S102). Then, the CPU 51 starts receiving output signals of the extension detecting unit 20 and the inclination detector 29 (step S103) and provides a signal to open the solenoid valves 72, 79 and 86 (step S104). Consequently, the pressurized working fluid is supplied through lines 80 and 77 to the hydraulic cylinders 9, through lines 87 and 84 to the hydraulic cylinders 18, and through the line 73 to the hydraulic 31 and 36 (step S105), and thereby the platform starts rising.

When the working fluid is supplied to the hydraulic cylinders 31 and 36, the piston rods 32 and 38 are projected to push out the second boom 10 from the first boom 6 and to push out the third boom 11 from the second boom 10 so that the stretchable boom 13 is stretched, the distance between the pins 7 and 15 being increased. The increment of the distance, namely, the extension of the stretchable boom 13, is detected by the extension detecting unit 20, which gives a signal corresponding to the extension of the stretchable boom 13 to the counter 59. As the piston rods of the hydraulic cylinders 9 are projected, the first boom 6 is turned on the pin 7 so that the inclination of the stretchable boom 13 to the vehicle 1 varies as the stretchable boom 13 is stretched. The inclination detector 29 detects the inclination of the first boom 6, hence the inclination of the stretchable boom 13, and gives a signal corresponding to the inclination of the first boom 6 to the ADC 56.

Then, the CPU processes the detection signals given thereto by the extension detecting unit 20 and the inclination detector 29 by Expression (1), where Ln is the detection signal of the extension detecting unit 20 and $\theta n$ is the detection signal of the inclination detector 29 (step S106). Then, the calculated value A is compared with a fixed value C corresponding to the distance between the center of the pin 7 and that of the pin 15 when the platform 16 is positioned at the lowermost position (step S107). When the difference between the calculated value A and the fixed value C is below a fixed value, the routine goes to step S108, where a decision is made as to whether or not the selector lever 66 is shifted. When the decision is NO, the routine goes to step S103, and when YES, the routine goes to step S109, where a decision is made as to the existing position of the selector lever 66 among the STOP-position, the UP-position and the DOWN-position.

When it is decided, at step S109, that the selector lever 66 is at the STOP-position, the operation of the pump is stopped at step S110. When the selector lever 66 is shifted at S111, a decision is made at step S112 as to whether or not the selector lever 66 is thrown to the UP-position. When it is decided that the selector lever 66 is thrown to the UP-position at step S112, the routine goes to step S113 to give a signal indicating that the selector lever 66 is at the UP-position is given to the IRI 57. Then, a decision is made as to whether or not the platform 16 has arrived at the uppermost position (step S114). If the platform 16 has arrived at the uppermost position, the routine goes to step S110 and, when not, the routine goes to step S102. On the other hand, when it is decided that the selector lever 66 is shifted to the DOWN-position at step S112, the routine goes to step S115 to give a singal indicating that the selector lever 66 is at the DOWN-position to the IRI 57, and then a decision is made as to whether or not the platform 16 is at the lowermost position at step S116. If the platform is at the lowermost position, the routine goes to STOP to complete the entire routine and, if not, the routine returns to step S103. When it is decided, at step S109, that the selector lever 66 is shifted to the UP-position, the routine goes to step S113 and, when it is decided that the selector lever 66 is at the DOWN-position, the routine goes to step S115.

When it is decide, at step S107, that the difference between the calculated value A and the fixed value C is greater tha a fixed value, the routine goes to step S118. At step S118. At step S118, the CPU 51 provides a command to make the DO 55 provide a control signal to control the solenoid valve 72 so that the extension (contraction, in lowering the platform 16) of the stretchable boom 13 is reduced, and a signal to control the solenoid valves 79 and 86 so that the projection of the respective piston rods of the hydraulic cylinders 9 and 18 (the contraction, in lowering the platform 16) is regulated to adjust the inclination of the stretchable boom 13 appropriately. At step S119, the detection signals provided by the extension detecting unit 20 and the inclination detector 29 are received through the counter 59, the DIO 54 and the ADC 56 and are calculated by Expression (1). At step S120, a decision is made as to whether or not the calculated value A coincides with the fixed value C. When the decision is NO, the routine goes to step S118 and, when YEN, the routine goes to step S103.

The rate of extending the stretchable boom 13 by the hydraulic cylinder 31 and 36 and the rate of tilting the stretchable boom 13 by the hydraulic cylinder 9 are controlled harmoniously through the above-mentioned series of procedures, so that the pin 15 attached to the fourth boom 12 is raised vertically with respect to the vehicle 1. The platform 16 is turned on the pin 15 by the hydraulic cylinders 18 so that the angle between the fourth boom 12 and the platform 16 is increased as the stretchable boom 13 is extended. Since the hydraulic cylinders 9 and the hydraulic cylinders 18 are matched to each other in the rate of projecting the piston rod, the platform 16 is always held in parallel to the deck of the vehicle 1, and thereby the vehicle 1, the stretchable boom 13 and the platform 16 form a configuration having the shape of a letter Z. Upon the arrival of the platform 16 at a predetermined level, the selector lever 66 is thrown to the STOP-position to stop the operation of the hydraulic cylinders 9, 18, 31 and 36, and thereby the platform 16 is held at the elevated level (steps S108 and S110) for work, such as assembling work, painting work or repairing work, at the elevated level. In extending the stretchable boom 13 by the hydraulic cylinders 31 and 36, the hydraulic cylinder 36 draws out the second boom 10 from both the third boom 11 and the fourth boom 12. At the same time, the spacer 41 slides along the outer surface of the third boom 11 following the movement of the upper end of the second boom 10. When the upper end of the second boom 10 approaches the lower end of the fourth boom 12, the stopping pins 44 pass through the recesses 43 of the slider 42 and the second boom 10 is allowed to be drawn out further beyond the lower end of the fourth boom 12. Finally, the spacer 41 is stopped by the stopping pins 44 and is retained at the lower end of the fourth boom 12 between the third boom 11 and the fourth boom 12. Thus, the spacer 41 fills up a space which has been occupied by the second boom 10 to receive a stress exerted upon the fourth boom 12 by the hydraulic cylinders 18 so that fourth boom 12 is kept in alignment with the third boom 11. In lowering the platform 16, the selector lever 66 is thrown to the DOWN-position at step S111, then, at step S112, the setting of the selector lever 66 at the DOWN-position is detected and the steps S115 and S116 are executed, and then the steps S103 through S120 are executed to retract the piston rods of the hydralic cylinders 9, 18, 31 and 36 so that the stretchable boom 13 is contracted to lower the platform holding the platform 16 in parallel to the deck of the vehicle 1. When the step S115 is executed, a decision is made, at step S116, as to whether or not the platform lowering operation is completed, and when the decision is YES, the platform lowering operation is stopped, and when NO, the routine goes to step S103.

Although the first embodiment employs a potentiometer as the inclination detector 29, the inclination detecotr 29 may be digital inclination detector.

A second embodiment of the present invention will be described hereinafter with reference to FIGS. 13 to 21. However, since the mechanical constitution, the constitution of the hydraulic system and the functions of the second embodiment are substantially the same as the first embodiment, the description thereof will be omitted to avoid duplication and only the components and functions which are different from those of the first embodiment will be described.

A stretchable boom 13 comprises a hollow first boom 6 having a rectangular cross section, a hollow second boom 10 having a rectangular cross section and slidably inserted in the first boom 6, a hollow third boom 11 having a rectangular cross section and slidably inserted in the second boom 10 and a cover 12 having a U-shaped cross section and fixedly receiving the upper end of the third boom 11. A clearance capable of receiving the first boom 6 is formed between the outer circumference of the third boom 11 and the inner circumference of the cover 12. When the stretchable boom 13 is fully contracted, the upper wall of the cover 12 overlaps the first boom 6. The first boom 6 has a length substatially the same as the length of the vehicle 1. The second boom 10 and the third boom 11 also have a length substantially the same as the length of the vehicle 1. A flat platform 16 having substantially the same floor area as the deck of the vehicle 1 is joined pivotally to the upper end of the cover 12 with a pin 15. A pair of hydraulic cylinders 18 each is joined pivotally to the platform 16 and the cover 12 at opposit ends for turning the platform 16 relative to the cover 12.

Figure 16:
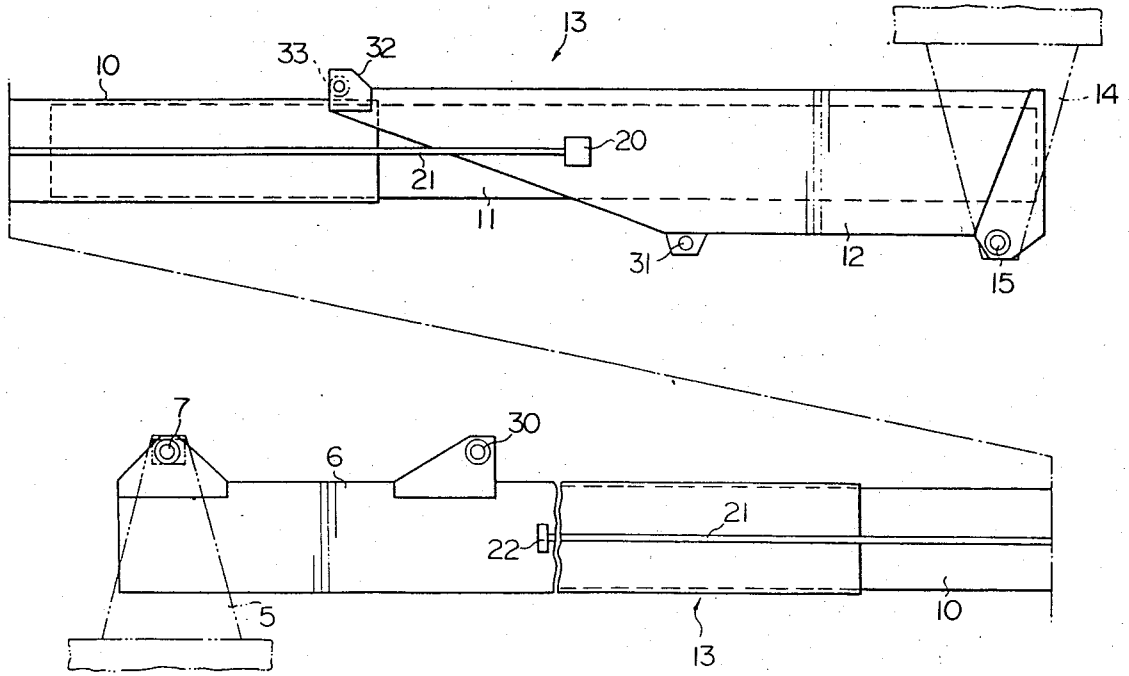
FIG. 16 is a schematic illustration showing the constitution of a stretchable boom of the second embodiment.
Figure 17:
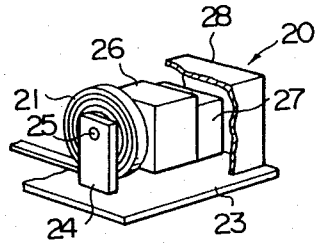
FIG. 17 is a perspective view of an extension detecting unit employed in the second embodiment.

Referring to FIG. 16, the first boom 6, the second boom 10 and the third boom 11 are inserted one in another in telescopic fashin. The side wall of the cover 12 has a substantially trapezoidal shape having, as viewed in FIG. 16, a perpendicular right lateral edge, an oblique left lateral edge, an upper base having a length about two-thirds of the length of the first boom 6 and a lower base having a length about one-third of the length of the first boom 6. Lugs each having a hole 30 are fixed to the upper surface of the first boom 6 at a osition about one-third of the length of the first boom 6 apart from the lower end of the same, for joining hydraulic cylindes 9 thereto. Holes 31 for joining hydraulic cylinders 18 thereto are fomed in the lower bases of the side walls of the cover 12, respectively, at a position corresponding to the middle of the upper base. Brackets 32 are fixed to the upper surface of the cover 12 at the left end. Rollers 33 is supported rotatably in the brackets 32 so as to roll along the upper surface of the first boom 6.

Figure 18:
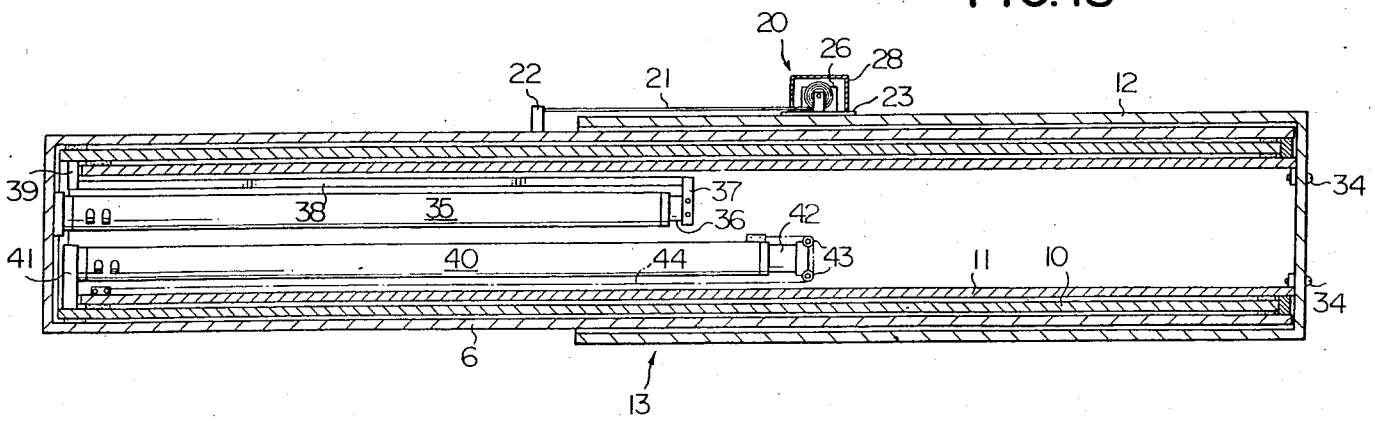
FIG. 18 is a longitudinal sectional view of the stretchable boom of FIG. 16.

As illustrated in FIG. 18, the third boom 11 is fastened at the upper end thereof to the upper end of te cover 12 with bolts 34. A hydraulic cylinder 35 is disosed longitudinally inside the third boom 11 with the base end thereof fixed to the first boom 6. An adapter 37 is fixed to the free end of the piston rod 36 of the hydraulic cylinder 35 so as to project from the piston rod 36 perpendicularly to the longitudinal axis of the hydraulic cylinder 35. A rod 38 is extended in parallel to the hydraulic cylinder 35 and is fixed at one end to the adapter 37 and the other end through a block 39 to lower end of the second boom 10. A hydraulic cylinder 40 is disposed inside the third boom 11 with the base end thereof fixed to a block 41 fixed to the lower end of the second boom 10. A wire 44 connected at one end to the hydraulic cylinder 40 and at the other end to the lower and of the third boom 11 is extended around pulleys 43 pivotally supported on the free end of the piston rod 42 of the hydraulic cylinder 40.

Figure 19:
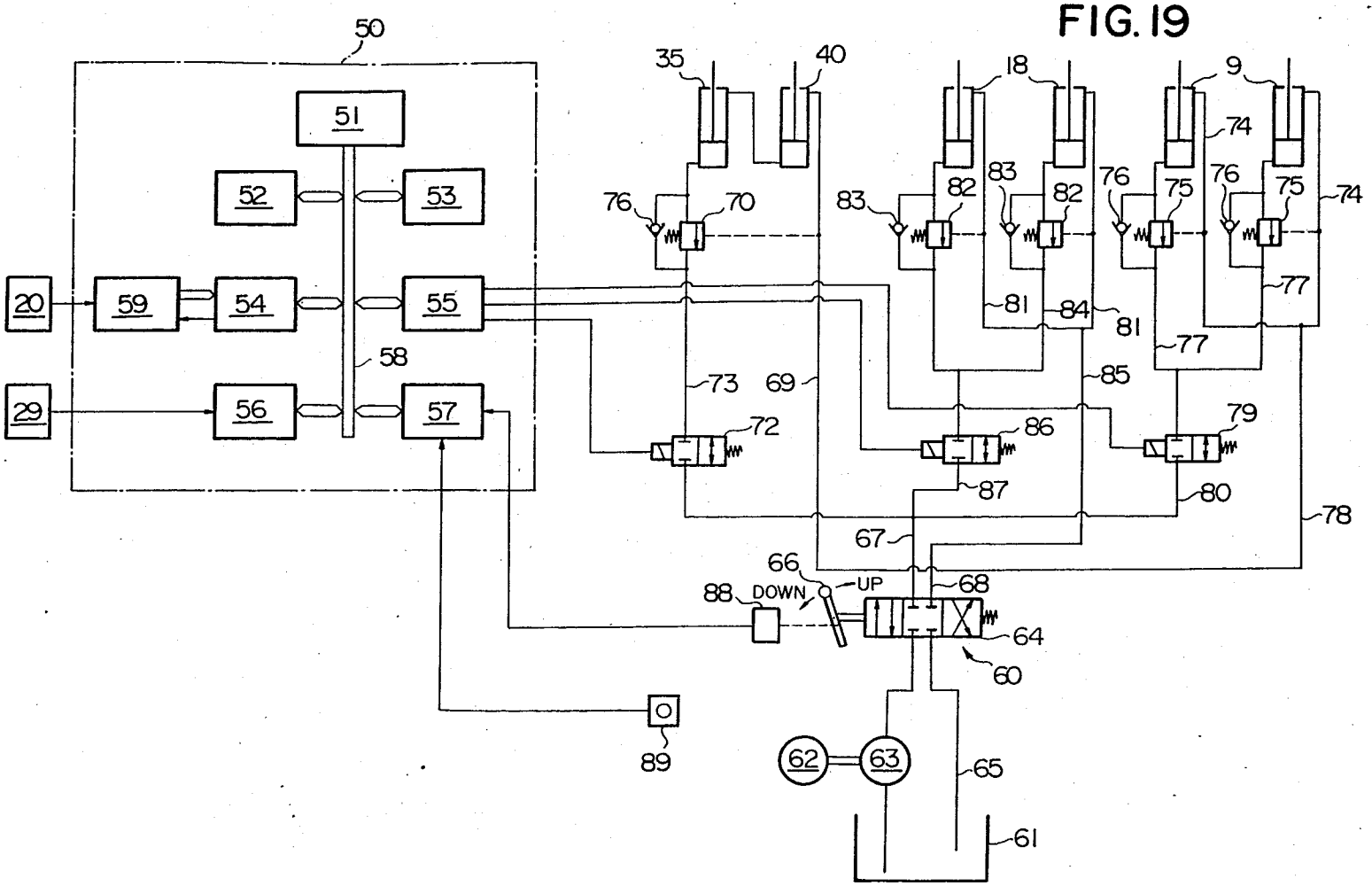
FIG. 19 is a hydraulic circuit diagram of a hydraulic control system employed in the second embodiment of the present invention.
Figure 20:
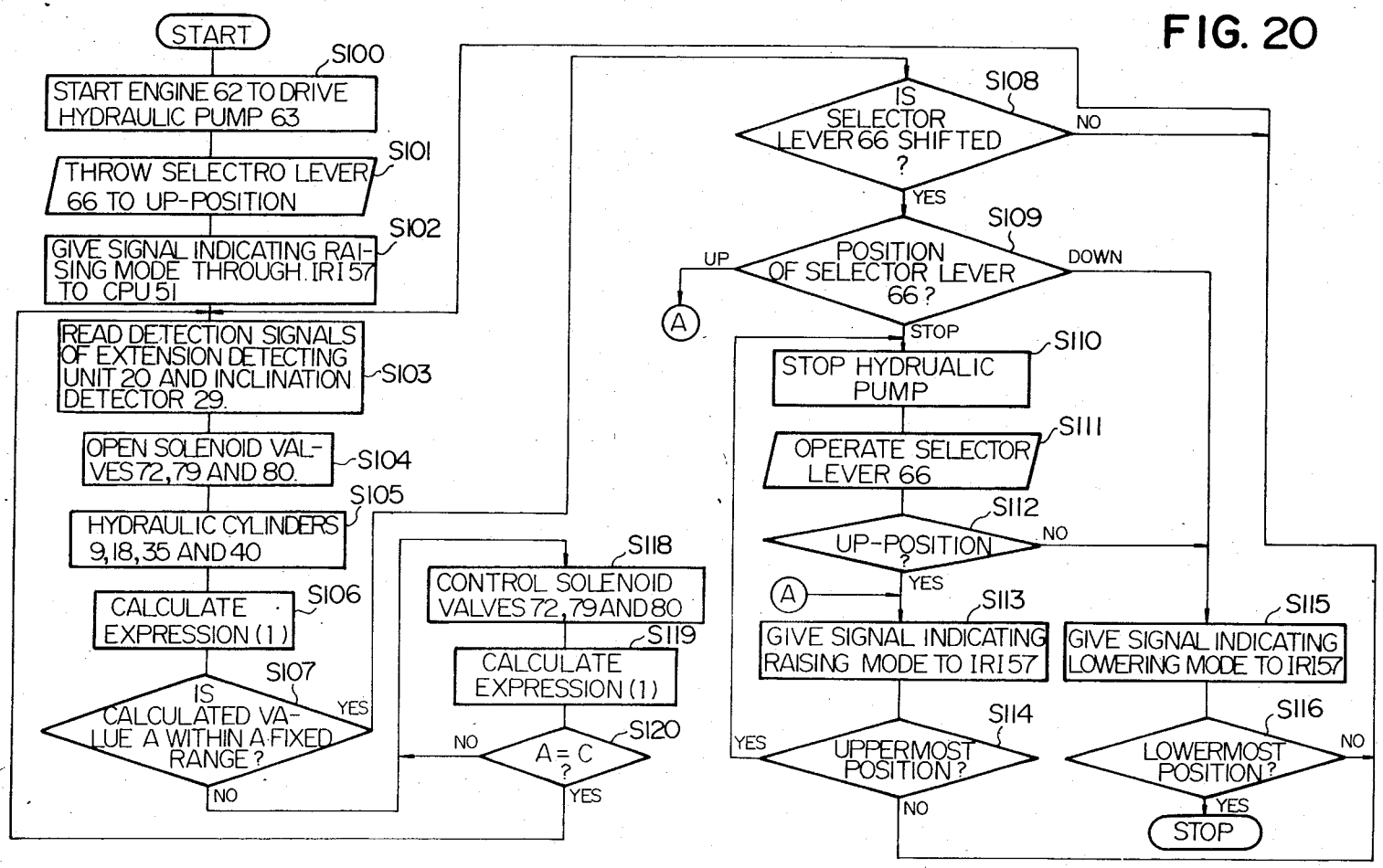
FIG. 20 is a flow chart of a control program for controlling the operation of the lifting apparatus of FIG. 13.
Figure 21:
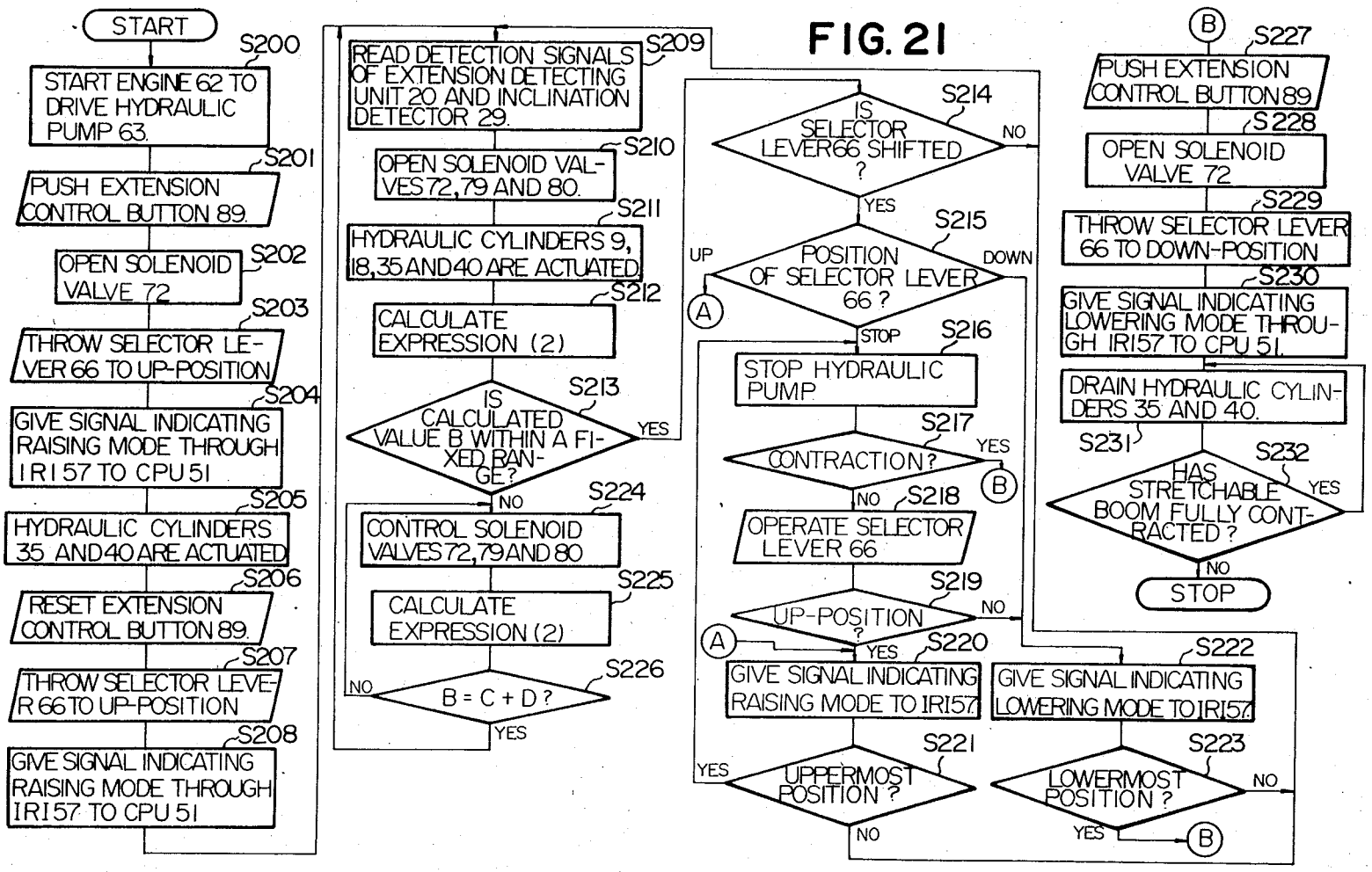
FIG. 21 is a flow chart of another control program for controlling the operation of the lifting apparatus of FIG. 13.
Figure 22:
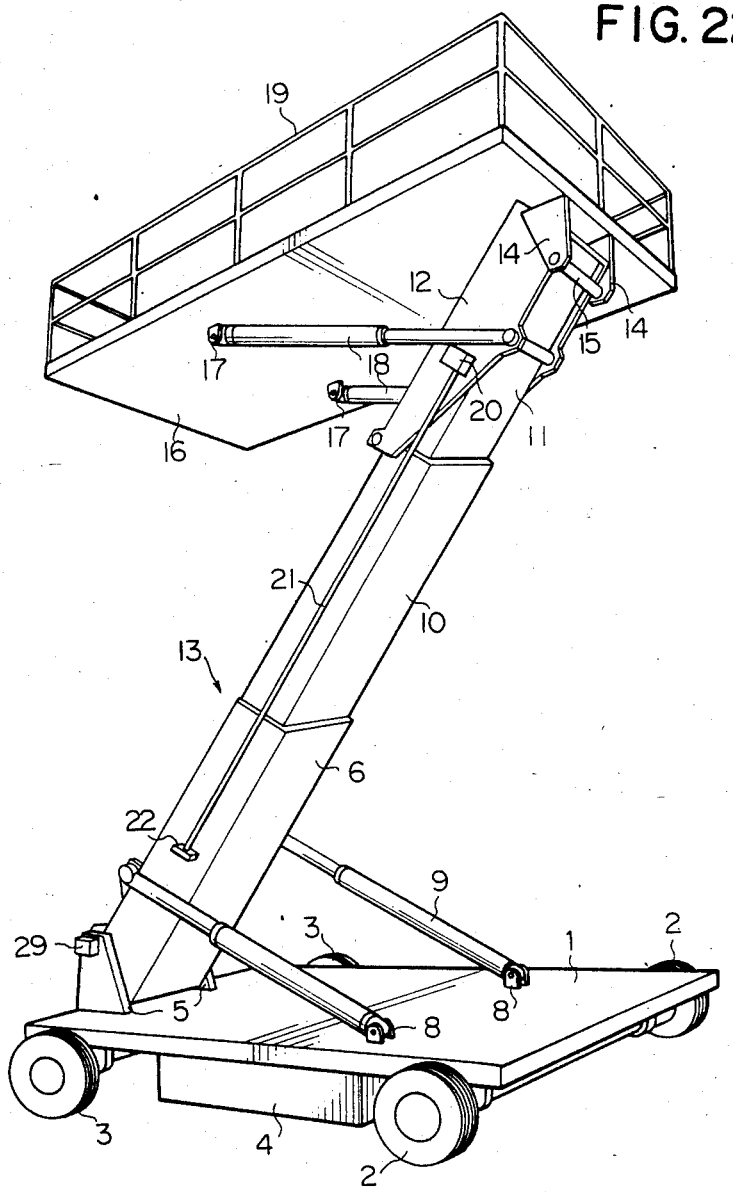
FIG. 22 is a perspective view of a lifting apparatus, in a third embodiment, according to the present invention.

As illustrated in FIG. 19, a hydraulic control system employed in the second embodiment comprises a control circuit 50 and a hydraulic circuit 60, which are substantially the same as those of the first embodiment in constitution and function, except that the control circuit 50 of the second embodiment is provided with a extension control button 89.

The function of the second embodiment will be described hereinafter with reference to FIGS. 13 to 20.

Vertical Raising and Lowering of the Platform 16:

In raising the platform 16, the engine 62 of the power unit 4 is started to drive the hydraulic pump 63 to supply pressurized working fluid to the hydraulic circuit (step S100), and then the selector lever 66 is thrown to the UP-position (step S101). The driving sensor 88 detects the position of the selector lever 66 and gives a signal indicating that the selector lever is snited to the UP-position through the IRI 57 to the CPU 51 (step S102). Then, the CPU 51 starts reading the detection signals of the extension detection unit 20 and the inclination detector 29 (step S103) and opens the solenoid valves 72, 79 and 86 (step S104). Consequently, the working fluid is supplied through lines 80 and 77, a line 87 and a line 73 to the hydraulic cylinders 9, the hydralic cylinders 18 and the hydralic cylinders 35 and 40, respectively (step S105) to start raising the platform 16.

When the hydraulic cylinders 35 and 40 are actuated, the piston rods 32 and 38 draw out the second boom 10 from the first boom 6, and the third boom 11 from the second boom 10, respectively, so that the distance between the pins 7 and 15 increases, and hence the stretchable boom 13 is extended. The extension detecting unit 20 detects the extension of the stretchable boom 13 and gives a detection signal corresponding to the extension of the stretchable boom 13 to the counter 59. When actuated, the hydraulic cylinders 9 turn the first boom 6 on the pin 7 to increase the inclination of the stretchable boom 13 to the vehicle 1 gradually. The inclination detector 29 detects the inclination of the stretchable boom 13 and gives a signal corresposnding to the inclinationt o the ADC 56.

The CPU 51 calculates the horizontal distance between the respective centers of the pins 7 and 15 by Expression (1) by using the detection signals of the extension detecting unit 20 and the inclination derector 29 (step S106). The calculated value A is compared with a fixed value C corresponding to the distance between the respective centers of the pins 7 and 15 when the stretchable boom 13 is fully contracted (step S107). When the difference between the calculated value A and the fixed value C is less than a fixed value the control routine goes to step S108. At step S108 a decision is made as to whether or not the selector lever 66 is shifted and, when not, the routine returns to step S103 and, when the decision is YES, the routine goes to step S109, where the position of the selector lever, namely, UP-position, STOP-position or DOWN-position, is decided.

When it is decided that the selector lever 66 is at STOP-position at step S109, the hydraulic pump is stopped at step S110. The selector lever 66 is operated at step S111 and the position of the selector lever 66 is decided at step S112. When it is decided that the selector lever 66 is shifted to UP-position, the routine goes to step S113, where a signal indicating that the selector lever 66 is at UP-position is given to the IRI 57, and then a decision is made at step S114 as to whether or not the platform 16 is raised to the uppermost position; when the decision is YES, the routine goes to step S110 and, when NO, the routine returns to step S102. On the other hand, when it is decided that the selector lever is at DOWN-position at step S112, the routine goes to step S115, where a signal indicating that the selector lever 66 is at DOWN-position is given to the IRI 57, and then, at step S116, a decision is made as to whether or not the platform 16 is at the lowermost position; when the decision is YES, the routine is completed and, when NO, the routine returns to step S103. When it is decided, at step S109, that the selector lever 6 is at the UP-postion, the routine goes to step S113 and, when at the DOWN-position, the routine goes to step S115.

When it is decided that the difference between the calculated value A and the fixed value C is greater than the fixed value at step S107, the routine goes to step S118, where the CPU 51 gives a command to make the DO 55 provide control signals to control the solenoid valve 72 so that the rate of extension (rate of contraction, in the lowering mode) of the stretchable boom 13 is regulated properly and to control the solenoid valves 79 and 86 so that the hydraulic cylinders 9 and 18 are controlled to keep the stretchable boom 13 at an appropriate inclination. At step S119, the CPU 51 receives the detection signals of the extension detecting unit 20 and the inclination detector 29 through the counter 59 and the DIO 54 and through the ADC 56 and calculate the value A by Expression (1) by using the detection signals. At step S120, a decision is made as to whether the calculated value A coincides with the fixed value C or not and, when the decision is NO, the routine goes to step S118 and, when YES, the routine returns to step S103.

Thus, the rate of extending the stretchable boom 13 by the hydraulic cylinders 35 and 40 is matched with the rate of turning the stretchable boom 13 by the hydraulic cylinders 9 through the above mentioned series of procedures, so that the pin 15 pivotally joining the cover 12 to the platform 16 is raised vertically relaive to the vehicle 1. The platform 16 is turned on the pin 15 by the hydraulic cylinders 18 so that the angle between the cover 12 and the platform 16 is increased as the stretchable boom 13 is extended. Since the hydraulic cylinders 9 and the hydraulic cylinders 18 are matched to each other in the rate of projecting the piston rod, the platform 16 is always held in parallel to the deck of the vehicle 1, and thereby the vehicle 1, the stretchable boom 13 and the platform 16 form a configuration having the shape of a letter Z. Upon the arrival of the platform 16 at a predetermined level, the selector lever 66 is thrown to the STOP-position to stop the operation of the hydraulic cylinders 9, 18, 35 and 40, and thereby the platform 16 is held at the elevated level (step S108 and S110) for work, such as assembling work, painting work or repairing work, at the elevated level.

To lower the platform 16, the selector lever 66 is thrown to the DOWN-position at step S111. At step S112, a decision that the selector lever 66 is shifted to the DOWN-position is made, and then the routine goes to steps S115 and S116. Then, the procedures of steps S103 to S120 are executed to drain the hydrulic cylinders 9, 18, 35 and 40 to contract the stretchable boom 13, and thereby the platform 16 is lowered being held in parallel to the vehicle 1. After step S115 has been executed, a decision is made at step S116 and, when the decision is YES, the routine is completed and, when NO, the routine returns to step S103.

Vertical Raising and Lowering of the Platform 16 above a Point in front of the Vehicle 1 (FIG. 21):

To raise the platform 16 vertically after extending the stretchable boom 13 horizontally by a distance D, the engine 62 of the power unit 4 is started to drive the pump 63 to supply the working fluid to the hydraulic circuit 60 (step S200), and then the extension control button 89 is pushed (step S201) to give a signal indicating that the stretchable boom 13 is only to be extended through teh IRI 57 to the CPU 51. Then, only the solenoid valve 72 is opened, while the solenoid valves 79 and 86 are kept closed (step S202). Then, the selector lever 66 is shifted to the UP-position (step S203). Then, at step S204, the driving sensor 88 detects the position of the selector lever 66 and gives a signal indicaing that the selector lever is at the UP-position through the IRI 57 to the CPU 51, and thereby the hydraulic cyliers 35 and 40 are actuated to extend the stretchable boom 13 (step S205). Upon the extension of the stretchable boom 13 by a desired length, the extension control button 89 is reset (step S206) to stop extending the stretchable boom 13. In this state, it is supposed that the stretchable boom 13 is extended by a distance D and the distance between the respective centers of the pins 7 and 15 is C+D.

Then, the selector lever 66 is shifted to the UP-position (step S207). Then, the driving sensor 88 detects the shift of the selector lever 66 to the UP-position and gives a signal indicating that the selector lever 66 is at the UP-position through the IRI 57 to the CPU 51 (step S208). Upon the reception of the signal from the driving sensor 88, the CPU 51 starts reading the detection signals of the extension detecting unit 20 and the inclination detector 29 (S209) and opens the solenoid valves 72, 79 and 86 (step S210). Consequently, the working fluid is supplied through the line 73, the lins 87 and 84 and the lines 80 and 77 to the hydraulic cylinders 35 and 40, the hydraulic cylinders 18 and the hydraulic cylinders 9, respectively (step S211), so that the platform 16 starts rising.

When the hydraulic cylinders 35 and 40 are actuated, the piston rods 32 and 38 are extended to draw out the second boom 10 from the first boom 6 and to draw out the third boom 11 from the second boom 10 to extend the distance between the pins 7 and 15. The extension detecting unit 20 detects the extension of the distance between the pins 7 and 15, namely, the extension of the stretachble boom 13, and gives a detection signal corresponding to the extension to the counter 59. The hydraulic cylinders 9 turns the first boom 6 on the pin 7 to increase the inclination of the stretchable boom 13 gradually as the same is extended. The inclination detector 29 detects the inclination of the stretchable boom 13 and gives a detection signal corresponding to the inclination to the ADC 56.

Then, the CPU 51 calculates the horizontal distance of the center of the pin 15 from the center of the pin by Expression (1) by using the detection signals (step S212). The calculated value A is compared with the value C+D (step S213) and when the difference between the calculated value A and the value C+D is smaller than a predetermined value, the routine goes to step S 214. At step S 214, a decision is made as to whether or not the selector lever 66 is shifted and, when the decision is NO, the routine goes to step S209 and, when YES, the routine goes to step S215, where the position of the selector lever 66 is decided.

When it is found, at step S215, that the selector lever 66 is at the STOP-position, the hydraulic pump is stopped at step S216. To contract the stretchable boom 13 thereafter, the routine goes to step S227 and, when the stretchable boom 13 need not be contracted, the routine goes to step S218, here the selector lever 66 is operated. At step S219, a decision is made as to whether or not the selector lever 66 is thrown to the UP-position and, when the decision is YES, the routine goes to step S220, where a signal indicaing that the selector lever 66 is shifted to the UP-position is given to the IRI 57. Then, at step S221, a decision is made as to whether or not the plaform 16 has arrived at the uppermost position and, when the decision is YES, the routine goes to step S216 and, when NO, the routine goes to step S208. On the other hand, when it is decided the selector lever 66 is shifted to the DOWN-position at step S219, the routine goes to step S222, where a signal indicating that the selector lever 66 is shifted to the DOWN-position is given to the IRI 57. Then a decision is made, at step S223, as to whether the platform 16 has reached the lowermost position and, when the decison is NO, the routine goes to step S209 and, when YES, a decision as to whethr or not the stretchable boom 13 needs to be contracted is required. When decision that the selector lever 66 is shifted to the UP-position at step S215, the routine goes to step S222 and when the DOWN-position, the routine goes to step S221.

When the decision at step S213 is that the calculated result A is not equal to C+D and the difference between the calculated value A and the value C+D is greater than the fixed value, the routine goes to step S224. At step S224, the CPU 51 gives a command to make the DO 55 provide control signals to control the solenoid valve 72 so that the rate of extension (rate of contraction, in lowering the platform 16) of the stretchable boom 13 and also to control the solenoid valves 79 and 86 so that the rate of variation of the inclination of the stretchable boom 13 is regulated properly by the hydraulic cylinders 9 and 18. At step S 225, the CPU 51 receives the detection signals of the extension detecting unit 20 and the inclination detector 29 through the counter 59 and the DIO 54 and through the ADC 56 and calculates the horizontal distance between the centers of the pins 7 and 15 by Expression (1) by using the detection signals. At step S226, a decision is made as to whether or not the calculated value A coincides with the value C+D; when the decision is NO, the routine goes to step S224 and, when YES, the routine goes to step S209.

Thus, the rate of extending the stretchable boom 13 by the hydraulic cylinders 35 and 40 and the rate of turning the stretchable boom 13 by the hydraulic cylinders 9 are matched to each other, so that the pin 15 joining the cover 12 to the platform 16 is raised vertically relative to a horizontal plane containing the upper of the deck of the vehicle 1. The hydraulic cylinders 18 turns the platform 16 on the pin 15 to increase the angle between the platform 16 and the cover 12 as the inclination of the stretchable boom 13 increases. Since the hydraulic cyliners 9 and the hydraulic cylinders 18 are matched to each other in the rate of extension, the platorm 16 is always kept in parallel position relative to the vehicle 1, so that the vehicle 1, the stretchable boom 13 and the platform 16 form a configuration having the shape of a letter Z, as viewed sideways. Upon the arrival of the platform 16 at a desired level, the selector lever 66 is shifted to the STOP-position to stop the operation of the hydraulic cyliners 9, 18, 35 and 40, and thereby the platform 16 is held at the level (step S241 and S215) for work, such as assembling work, repairing work or painting work, at the elevated level. When the platform 16 is required to be lowered vertically therefrom, the selector lever 66 is shifted to the DOWN-position at step S218, and then the position of the selector lever 66 is decided at step S219. Then, steps S222 and S223 are executed successively, and then the same procedures of steps S209 to S226 are executed to drain the hydraulic cylinders 9, 18, 35 and 40 so that the stretachable boom 13 is contracted. Consequently, the platform 16 is lowered to the lowermost position in front of the vehicle 1 in a horizontal position. After the step S222 has been executed, a decision is made, at step S223, as to whether or not the platform 16 has been lowered to the lowermost position and, when the decison is YES, the routine is completed and, when NO, the routine goes to step S209.

After the platform 16 has been lowered to the lowermost position in front of the vehicle 1 at step S223, step S227 is selected at step S217 to contract the stretchable boom 13. To contract the stretchable boom 13, the extension control button 89 is pushed (step S227) to open the solenoid valve 72 and to close the solenoid valves 79 and 86 (step S228). Then, the selector lever 66 is shifted to the DOWN-position (step S229), and then a signal indicating that the selector lever 66 is shifted to the DOWN-position is given through the IRI 57 to the CPU 51 (step S230). The CPU 51 provides a command to retract the piston rods 36 and 42 of the hydraulic cylinders 35 and 40 (step S231), and thereby the stretchable boom 13 is contracted. During the contraction of the detachable boom 13, the length of the stretchable boom 13 is measured continuously by the extension detecting unit 20 to continue the contraction of the stretchable boom 13 until a decsion that the stretchable boom 13 has been contrcted to its minimum length, namely, until the second boom 10 and the third boom 11 have been retracted fully into the first boom 6 and the second boom 10, respectively, at step S232.

Thus, the platform 16 can be moved vertically with the stretchable boom 13 extended beyond the front of the vehicle 1 so that the pin 15 attached to the upper end of the stretchable boom 13 moves along the vertical to a plane containing the upper surface of the deck of the vehicle 1. Accordingly, in working along a vertical plane apart from the vehicle 1, such as in painting the surface of a wall apart from the vehicle, the platform 16 can be reached out to the plane for work along the same.

A third embodiment of the present invention will be described hereinafter with reference to FIGS. 22 to 30.

The third embodiment is calculated so as to raise a platform vertically from a vehicle to a desired elevated level and to move the platform in parallel to the upper surface of the deck of the vehicle on the elevated level. However, since the mechanical constitution, the constitution of the hydraulic system and functions of the third embodiment are substantially the same as the second embodiment except some modifications in the constitution and function of the hydraulic circuit, the description of those which are the same as the second embodiment will be omitted to avoid duplication and only components, constitution and functions which are different from those of the second embodiment will be described.

Figure 28:
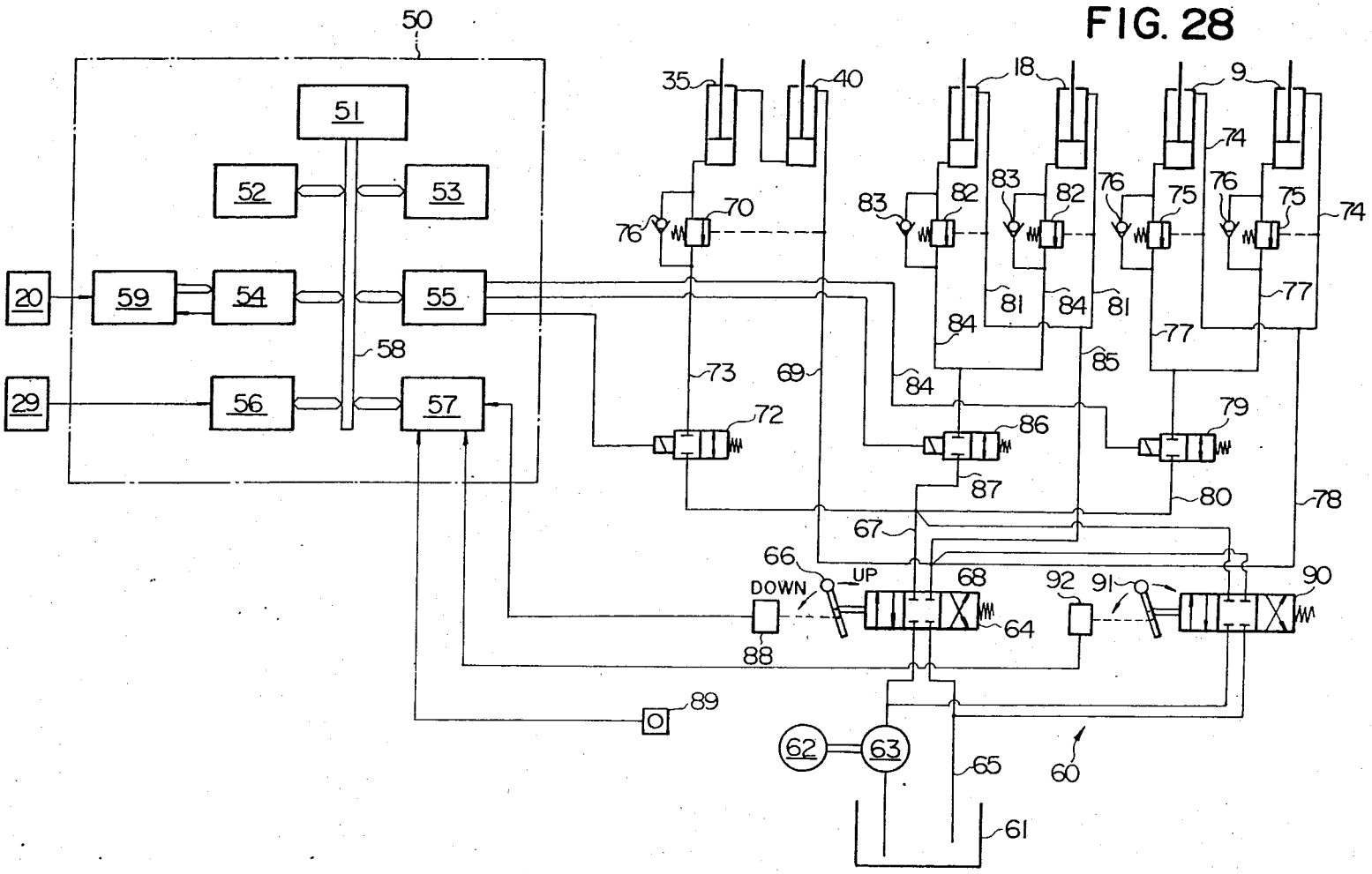
FIG. 28 is a hydraulic circuit diagram of a hydraulic control system employed in the third embodiment of the present invention.
Figure 29:
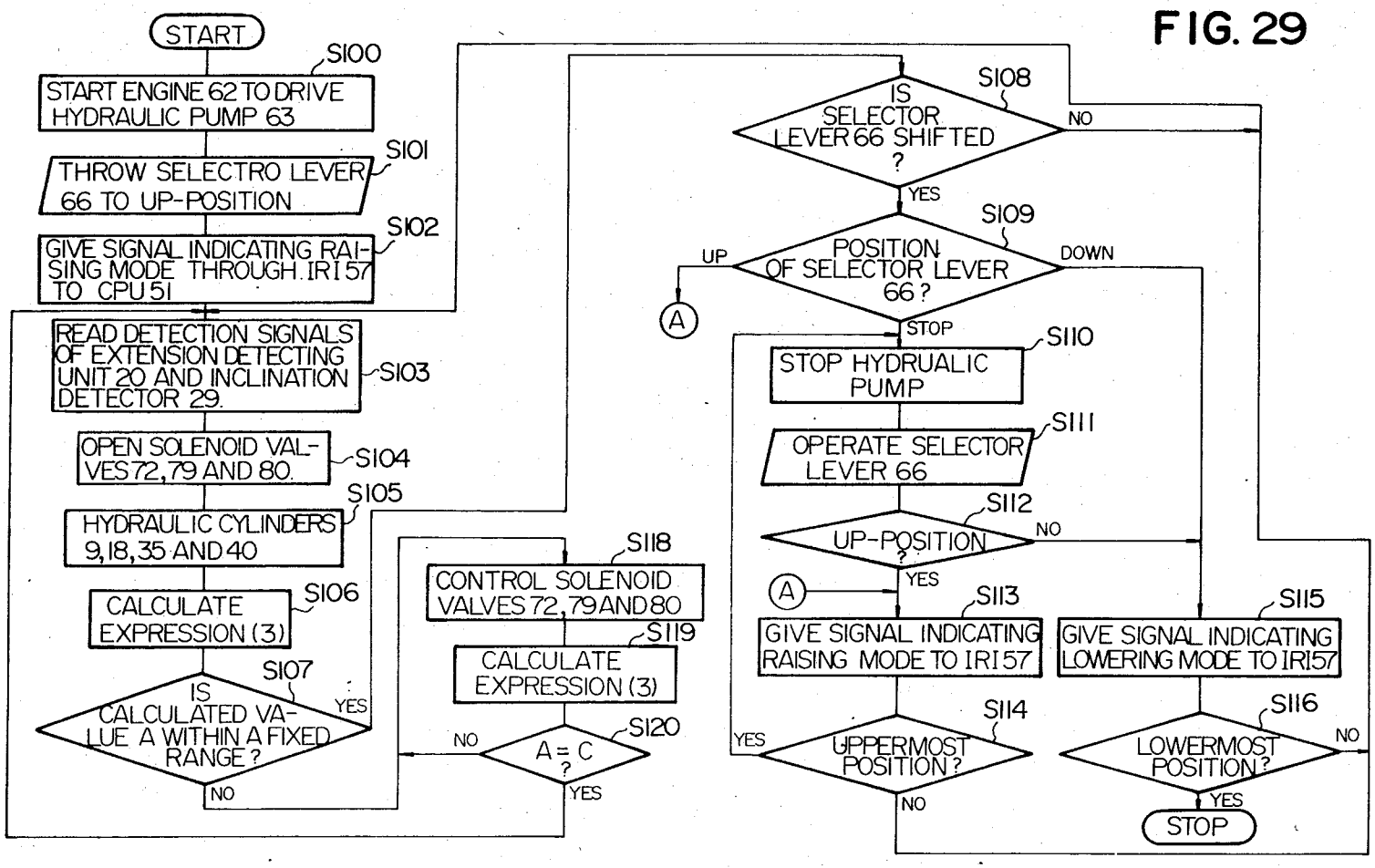
FIG. 29 is a flow chart of a control program for controlling the operation of the lifting aparatus of FIG. 22 to move the platform in vertical directions.

As best illustrated in FIG. 28, a hydraulic control system employed in the third embodiment is substantially the same as the hydraulic control system of the second embodiment illustrated in FIG. 19, except that the hydraulic control system of the third embodiment is provided additionally with a selector valve 90 for controlling the horizontal movement of a platform, a selector lever 91 and a driving sensor 92.

The selector valve 90 is connected to the hydraulic pump 63 and to the return pipe 65. The selector valve 90 is controlled by the selector lever 91 so as to connect the hydraulic pump 63 to either the line 67 or 68. The selector lever 91 is shifted between a STOP-position, a FORWARD-position and a BACKWARD-position. The driving sensor 92 detects the position of the selector lever 91. The selector valves 64 and 90 are interlocked mechanically to inhibit the simultaneous operation of the selector levers 66 and 91.

Functions of the third embodiment will be described hereinafter with reference to FIGS. 21 to 29.

Figure 23:
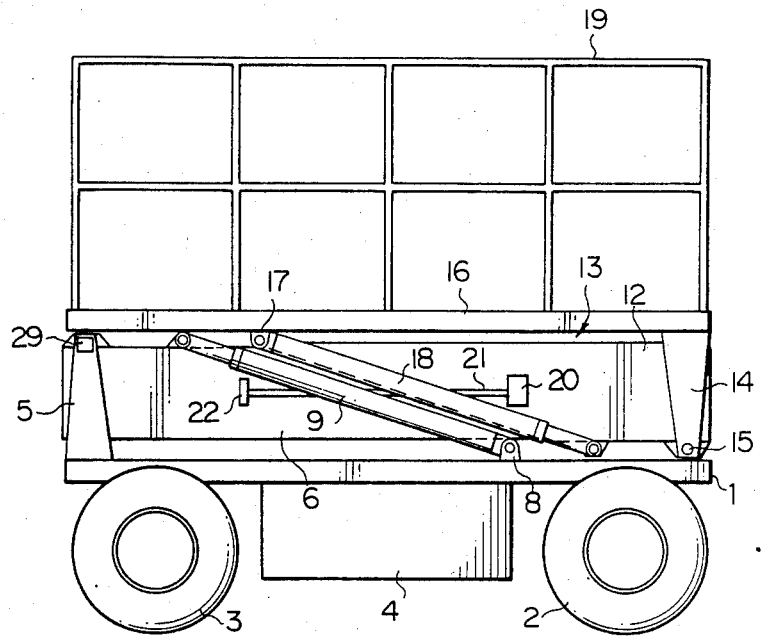
FIG. 23 is a side elevation of the lifting apparatus of FIG. 22, in which the platform is lowered to the lowermost position.
Figure 24:
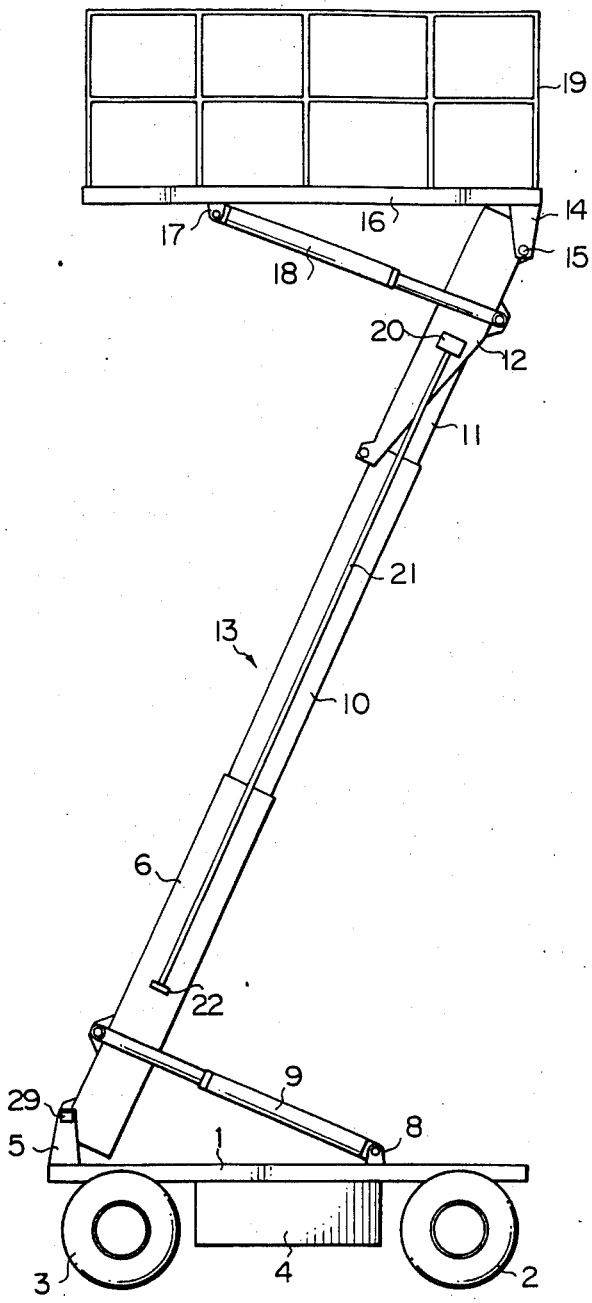
FIG. 24 is a side elevation of the lifting apparatus of FIG. 22, in which the platform is raised to the uppermost position.
Figure 25:
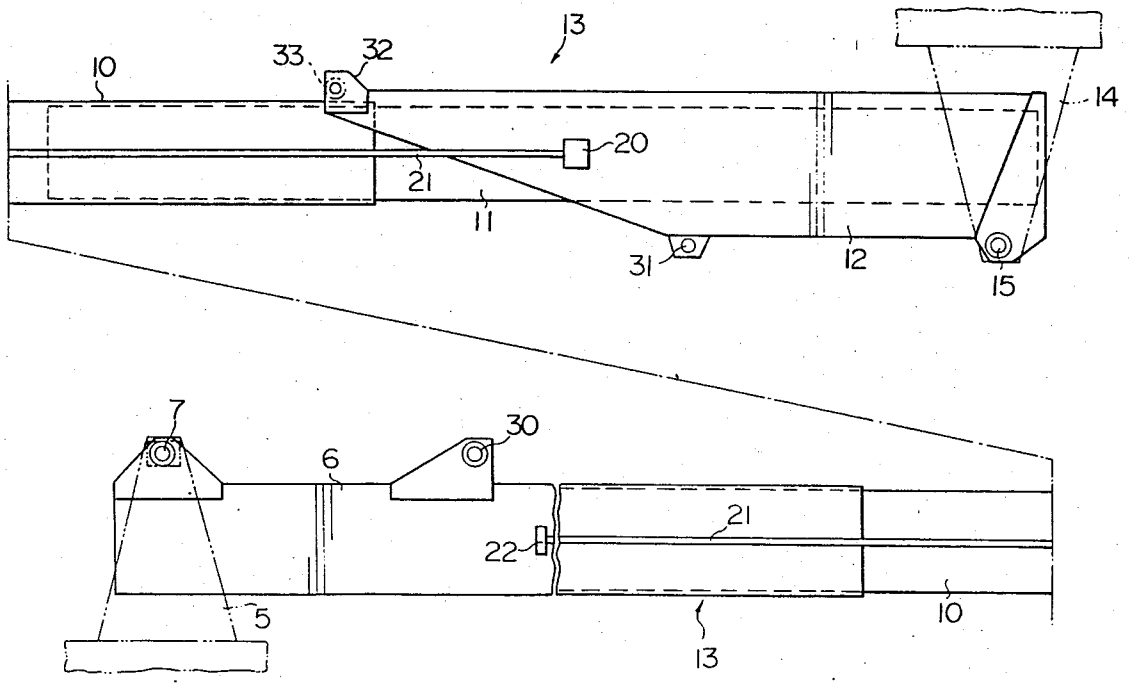
FIG. 25 is a schematic illustration showing the constitution of a stretchable boom employed in the third embodiment of the present invention.
Figure 26:
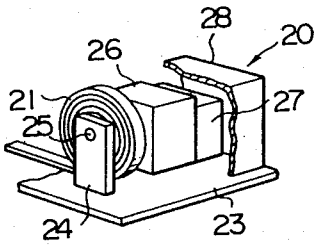
FIG. 26 is a perspective view of an extension detecting unit employed in the third embodiment of the present invention.
Figure 27:
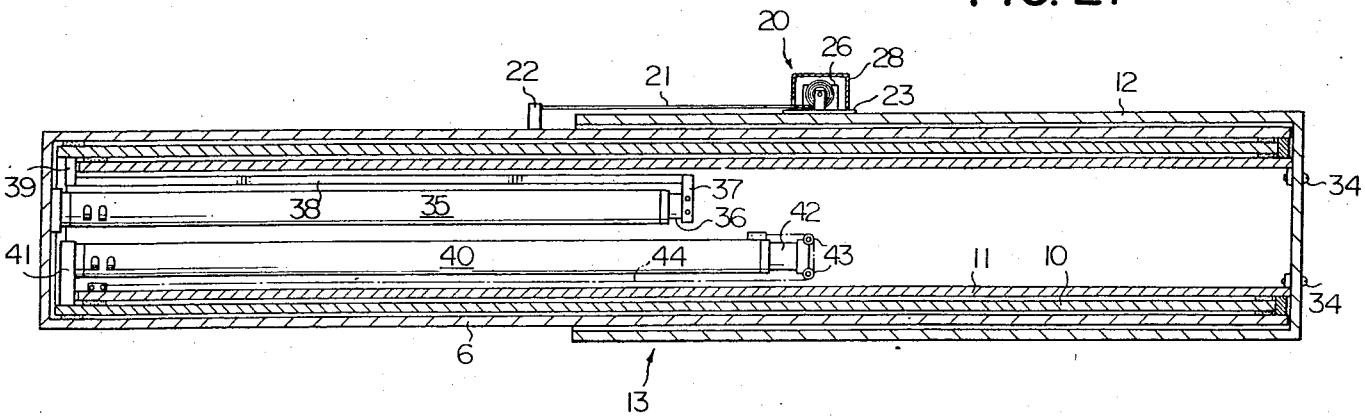
FIG. 27 is a longitudinal sectional view of the stretchable boom of FIG. 25.

Vertical Raising of the Platform 16:

In FIG. 23, the stretchable boom 13 is fully retracted and the plaform 16 is lowered to the lowermost position. In this state persons get on the platform 16 and/or materials are put on the platform 16, and then the platform 16 is raised. The engine 62 of the power unit 4 is started to drive the hydraulic pump 63 (step S100), and then the selector lever 66 is thrown to the UP-position (step S101). The driving sensor 88 detects the position of the selector lever 66 and gives a signal indicating that the selector lever 66 is shifted to the UP-position through the IRI 57 to the CPU 51 (step S102). Then, the CPU 51 starts reading detection signals given thereto by the extension detecting unit 20 and the inclination detector 29 (step S103) and provides a command to open the solenoid valves 72, 79 and 86 (step S104). Consequently, the working fluid is supplied through the line 72, the lines 87 and 84 and the lines 80 and 77 to the hydraulic cylinders 35 and 40, the hydraulic cylinders 18 and the hydraulic cylinders 9, respectively (step S105), so that the platform 16 starts rising.

When the hydraulic cylinders 35 and 40 are actuated, the piston rods 36 and 42 draw out the second boom 10 from the first boom 6, and the third boom from the second boom 10, respectively, to increase the distance between the pins 7 and 15. The extension detectin unit 20 detects the extension of the stretchable boom 13 and gives a detection signal corresponding to the extension of the stretchable boom 13 to the counter 59. The hydraulic cylinders 9 turns the first boom 6 on the pin 7 to increase the inclination of the stretchable boom 13 relative to the vehicle 1 gradually as the stretchable boom 13 is extended. The inclination detector 29 detects the inclination of the stretchable boom 13 and gives a detection signal corresponding to the inclination of the stretchable boom 13 to the ADC 56.

The CPU 51 calculates the distance between the center of the pins 7 and 15 by Expression (1) by using the detection signals of the extension detecting unit 20 and the inclination detector 29 (step S106). The calculated value A is compared with a fixed value C corresponding to the distance between the centers of the pins 7 and 15 when the stretchable boom 13 is fully contracted (step S107), and when the difference between the calculated value A and the fixed value C is smaller than a fixed value, the routine goes to step S108. At step S108, a decision is made as to whether or not the selector lever 66 is shifted and, when the decision is NO, the routine goes to step S103 and, when YES, the routine goes to step S109, where the position of the selector lever 66 is detected. If the selector lever 66 is found to be shifted to the STOP-position at step S109, the hydraulic pump is stopped at step S110. When the selector lever 66 is operated at step S111, a decision is made as to whether or not the selector lever 66 is shifted to te UP-position at step S112 and, when the decision is YES, the routine goes to step S113, where a signal indicating that the selector lever 66 is shifted to the UP-position is given to the IRI 57, and then a decision is made at step S114 as to whether or not the platform 16 has arrived at the uppermost position and, when the decision is YES, the routine goes to step S110 and, when NO, the routine returns to step S102. On the other hand, when the selector lever 66 is found to be shifted to the DOWN-position at step Step S 112, the routine goes to step S115, where a signal indicaing that the selector lever 66 is shifted to the DOWN-position is given to the IRI 57. Then, at step S116, a decision is made as to whether the platform 16 has arrived at the lowermost position and, when the decision is YES, the control routine is completed and when NO, the routine returns to step S103. When the selector lever 66 is found to be shifted to th UP-position at step S109, the routine goes to step S113 and, when DOWN-position, the routine goes to step S115.

When it is decided at step S107 that the difference between the calculated value A and the fixed value C is greater than the fixed value, the routine goes to step S118. At step S118, the CPU 51 provides a command to make the DO 55 provide control signals to control the solenoid valve 72 so that the rate of extension of the stretchable boom 13 is regulated properly, and to control the solenoid valves 79 and 86 to regulate the rate of extension of the piston rods of the hydraulic cylinders 9 and 18 so that the inclination of the stretchable boom 13 is regulated properly. At step S119, the CPU 51 reads the detection signals of the extension detecting unit 20 and the inclination detector 29 through the counte 59 and the DIO 54 and through the ADC 56, and then the CPU 51 calculates the distance between the centers of the pins 7 and 15 by Expression (1) by using the detection signals. At step S120, a decision is made as to whether or not the calculated value A coincides with the fixed value C and, when the decision is YES, the routine goes to step S103 and, when NO, the routine goes to step S118.

The rate of extending the stretchable boom 13 by the hydraulic cylinders 25 and 40 and the rate of turning the stretchable boom 13 by the hydraulic cylinders 9 are mached to each other through a series of the above-mentioned procedures, so that the pin 15 attached to the cover 12 of the stretchable boom 13 is raised along a vertical line from the vehicle 1. The hydraulic cylinders 18 turns the plaform 16 on the pin 15 relative to the stretchable boom 13 so as to increase the angle between the platform 16 and the cover 12 gradually as the inclination of the stretchable boom 13 increases. The rate of extension of the hydraulic cylinders 18 is matched to that of the hydraulic cylinders 9 so that the platform 16 is always held in parallel to the deck of the vehicle 1. Thus, the vehicle 1, the stretchable boom 13 and the platform 16 form a configuration having the shape of a letter Z, as viewed sideways. Upon the arrival of the platform 16 at a desired level, the selector lever 66 is shifted to the STOP-position to stop the operation of the hydraulic cylinder 9, 18, 35 and 40. Then, the platform 16 is held at the elevated level (steps S108 and S110) for work, such as assembling work, repairing work or painting work, on the elevated level.

To lower the platform 16, the selector lever 66 is shifted to the DOWN-position at step S111 and the position of the selector lever 66 is detected at step S112. Then, steps S115 and S116 are executed, and then a series of steps S103 to S120 are executed to retract the piston rods of the hydraulic cylinder 9, 18, 35 and 40 so that the stretchable boom 13 is contracted and the inclination of the same is reduced to lower the platform 16 vertically in a position parallel to the deck of the vehicle 1. After step S115 has been executed, a decision is made at step S116 as to whether or not the platform 16 has been lowered to the lowermost position and, when the decision is YES, the routine is comleted and, when NO, the routine returns to step S103.

Figure 30:
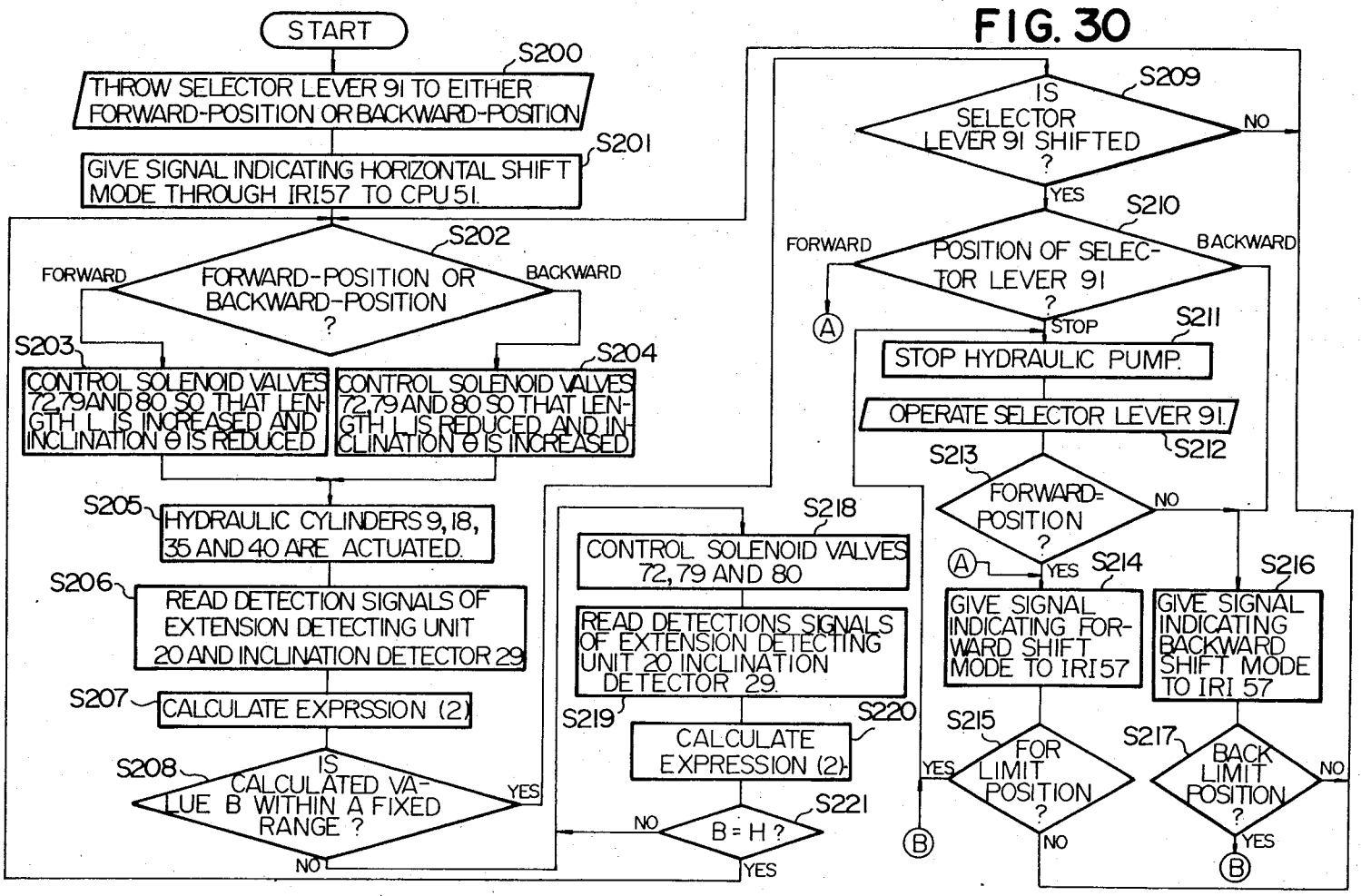
FIG. 30 is a flow chart of another control program for controlling the operation of the lifting apparatus of FIG. 22 to move the platform in horizontal direction.
Figure 31:
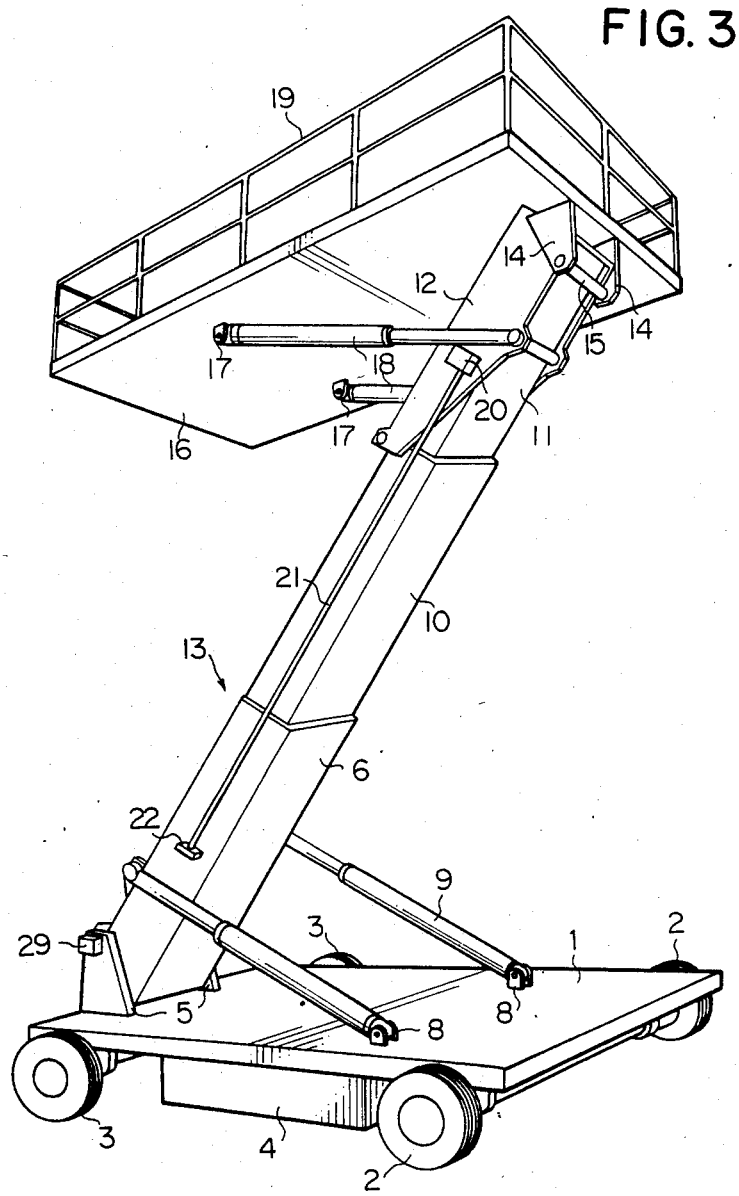
FIG. 31 is a perspective view of a lifting apparatus, in a fourth embodiment, according to the present invention.
Figure 32:
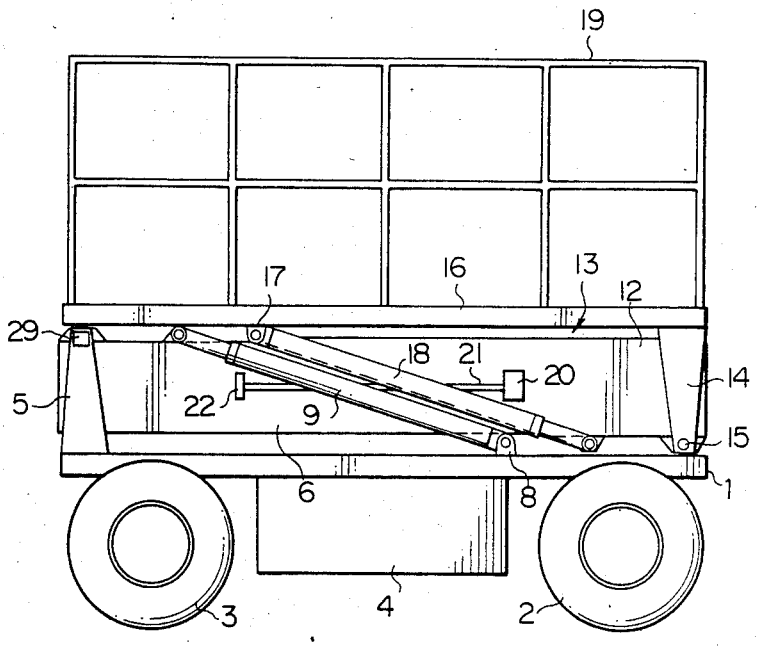
FIG. 32 is a side elevation of the lifting aparatus of FIG. 31, in which the platform is lowered to the lower most position.
Figure 33:
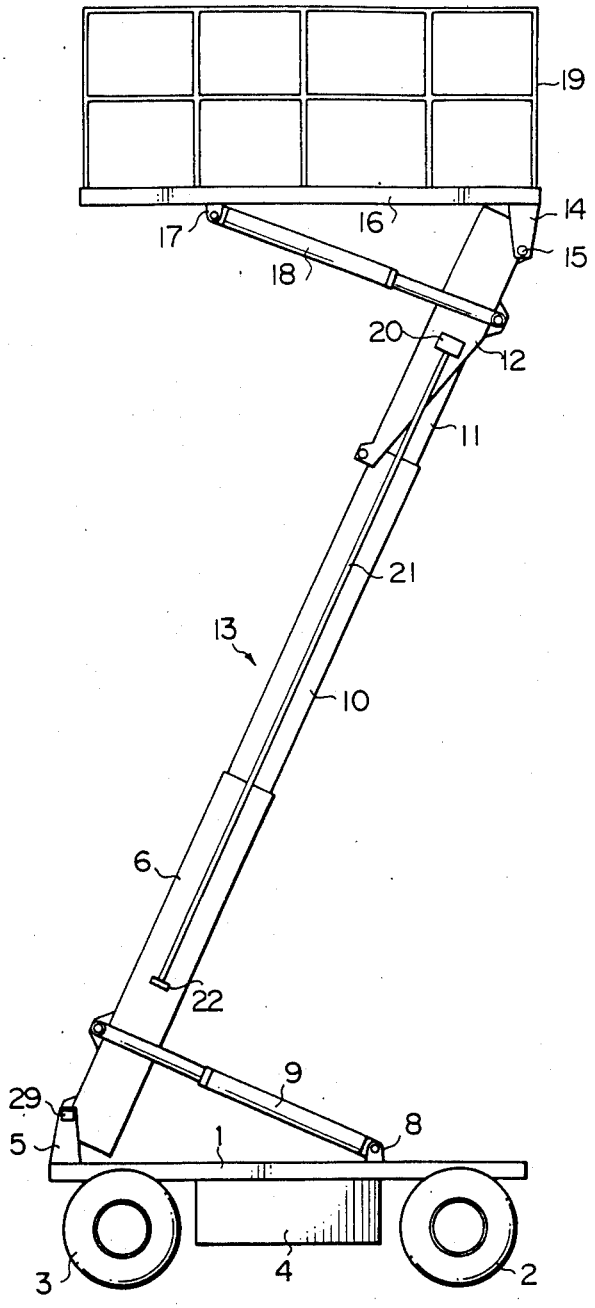
FIG. 33 is the lifting apparatus of the fourth embodiment in the raised uppermost position.
Figure 34:
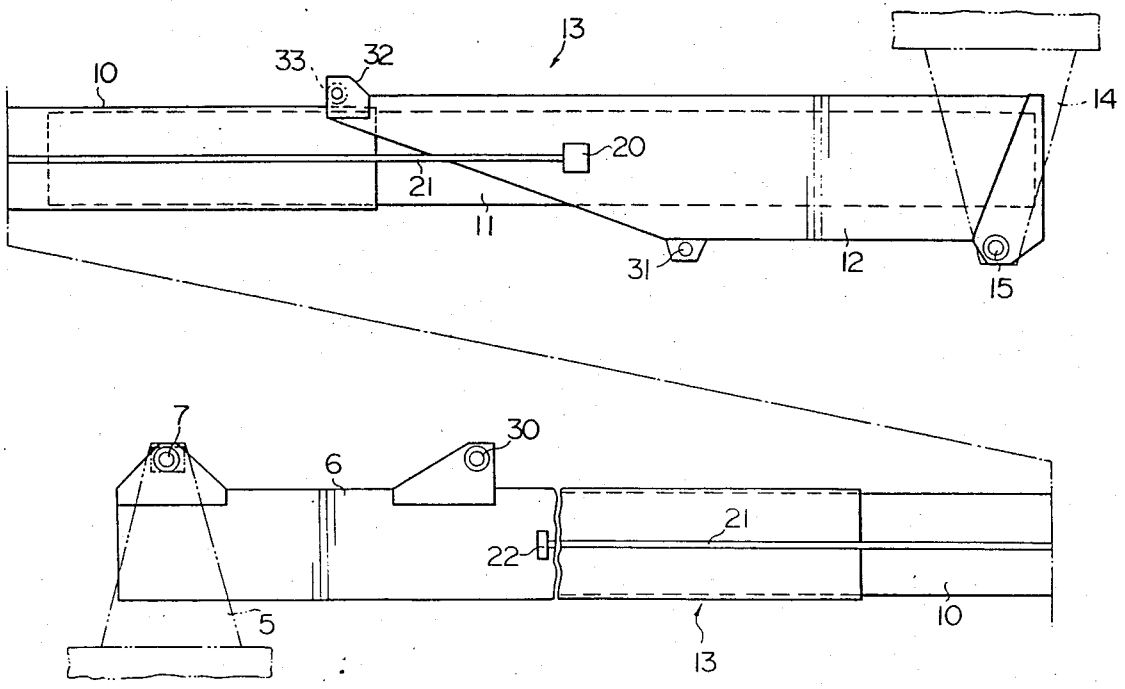
FIG. 34 is a schematic illustration showing the constitution of a stretchable boom employed in the fourth embodiment of the present invention.
Figure 35:
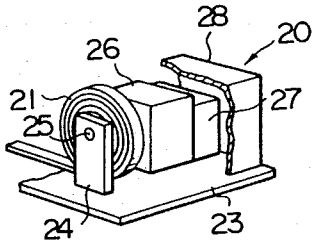
FIG. 35 is a perspective view of an extension detecting unit employed in the fourth embodiment of the present invention.
Figure 36:
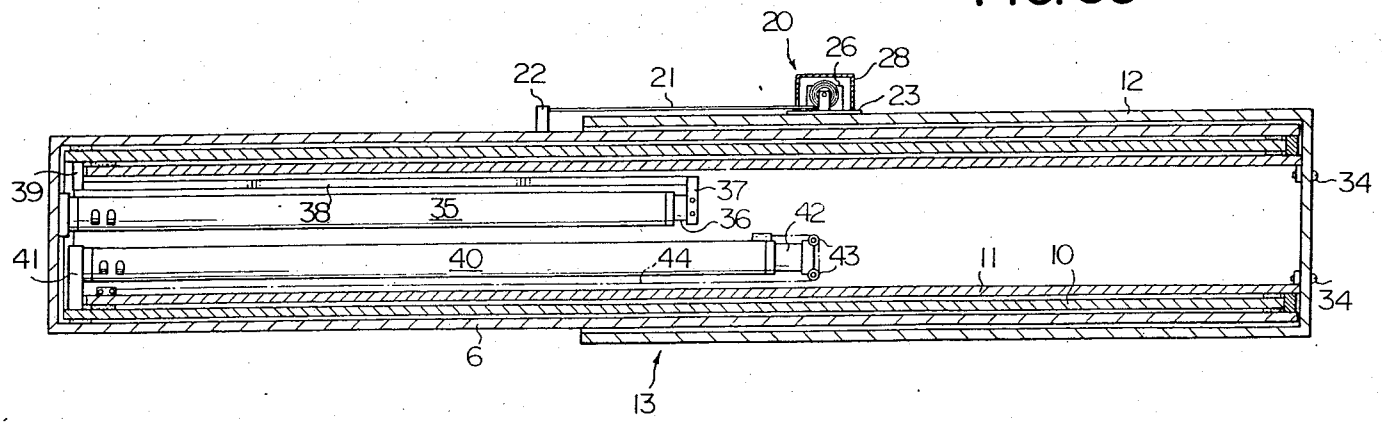
FIG. 36 is a longitudinal sectional view of the stretchable boom of FIG. 34.

Horizontal Movement of the Platform 16 at an Elevated Level:

The manner of horizontally moving the platform 16 at an elevated level will be described hereinafter with reference to FIGS. 12 and 30.

Figure 12:
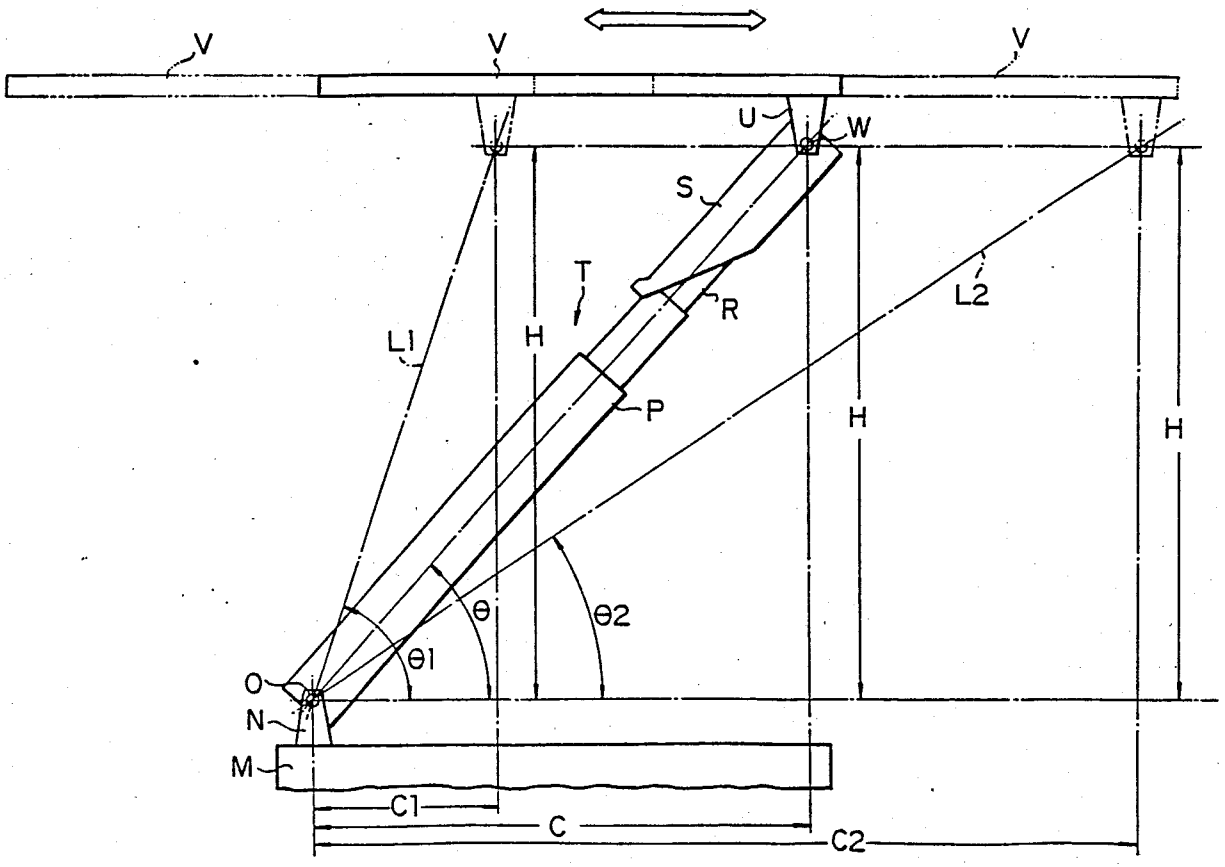
Figure 13:
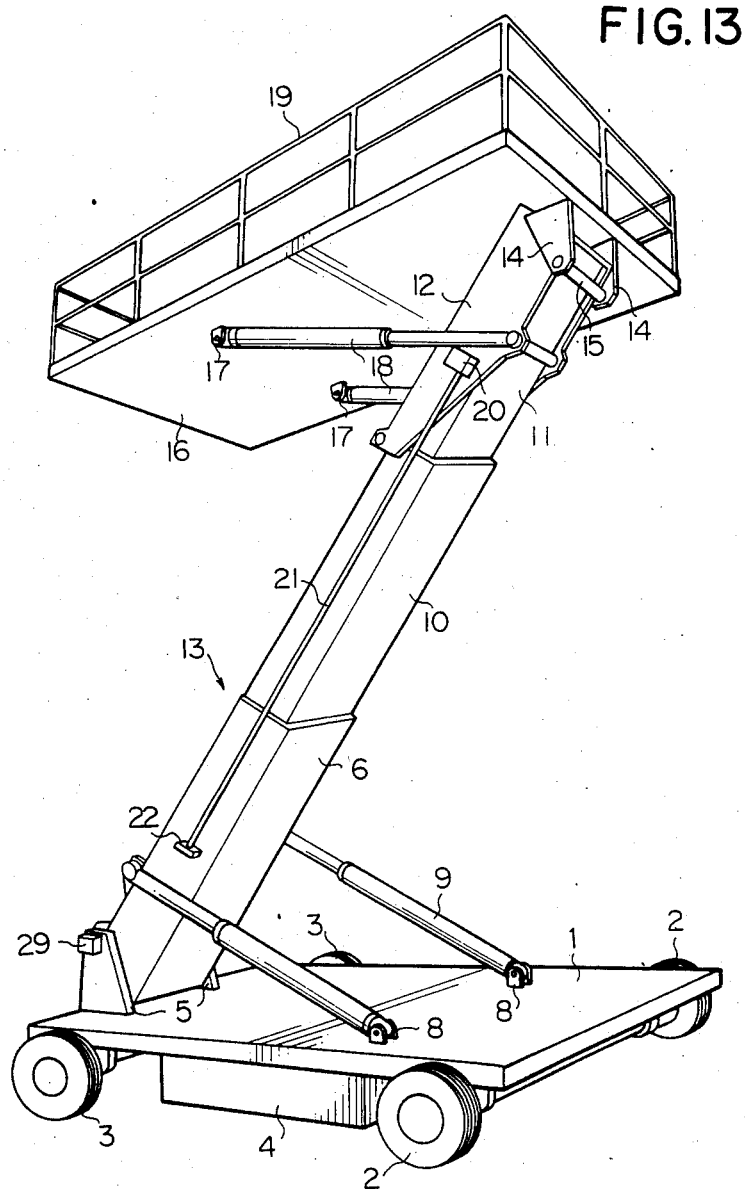
FIG. 13 is a perspective view of a lifting apparatus, in a second embodiment, according th to present invention.
Figure 14:
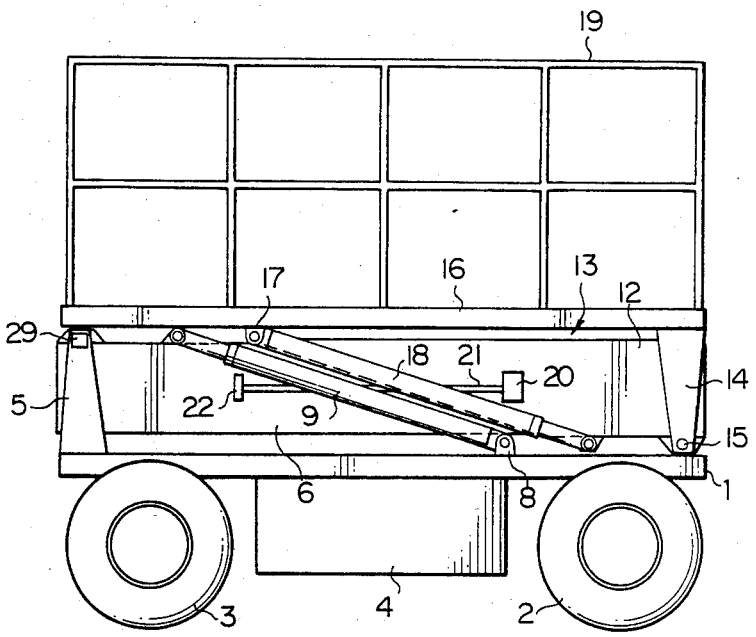
FIG. 14 is a side elevation of the lifting apparatus of FIG. 13, in which the platform is lowered to the lowermost position.
Figure 15:
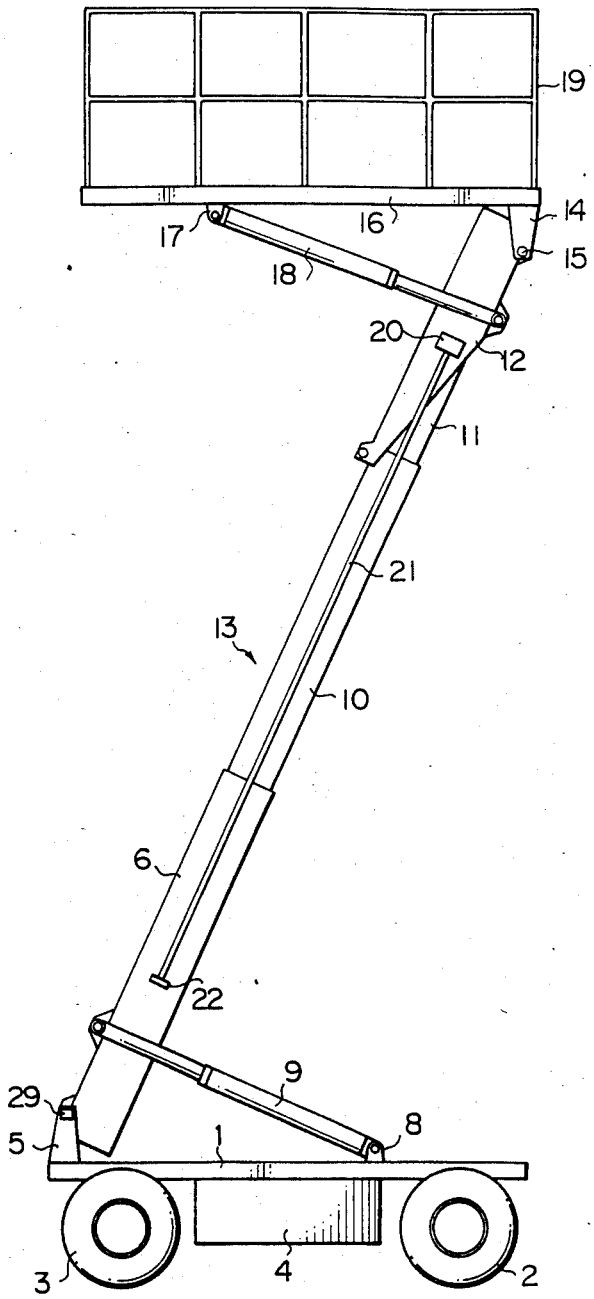
FIG. 15 is a side elevation of the lifting apparatus of FIG. 13, in which the platform is raised to the uppermost position.

In FIG. 12, the platform 16 is raised vertically to an elevated level as indicated by continuous lines. In this state, the extension control button 89 is pushed. To move the platform 16 horizontally at the elevated level from the position inidated by continuous lines in FIG. 12, the selector lever 91 is thrown to either the FORWARD-position or the BACKWARD-position (step S200). The driving sensor 92 detects the position of the selector lever 91 and gives a signal indicating that the hydraulic circuit is ready to move the platform 16 in horizontal directions through the IRI 57 to the CPU 51 (step S201). When the selector lever 91 is thrown to the FORWARD-position, the CPU 51 controls the solenoid valves 72, 79 and 80 so that the stretchable boom 13 is extended and the inclination $\theta$ of the stretachable boom 13 is reduced (step S203) and, when the selector lever 91 is thrown to the BACKWARD-position, the CPU 51 controls the solenoid valves 72, 79 and 80 so that the stretchable boom 13 is contracted and the inclination $\theta$ of the stretchable boom 13 is increased (step S204). Consequently, the working fluid is supplied through the line 73, the lines 87 and 84 and the lines 80 and 77 to the hydraulic clinders 35 and 40, hydraulic cylinders 18 and the hydraulic cylinders 9, respectively (step S205), while the CPU 51 starts reading the detection signals of the extension detecting unit 20 and the inclination detector 29 (step S206), and thereby the platform 16 is caused to start moving in a horizontal direction.

When the hydraulic cylinders 35 and 40 are actuated according to the control signal given by the CPU 51, the piston rods 36 and 42 are extended or retracted to extend the second boom 10 and the third boom 11 from or to retract the same into the first boom 6 and the second boom 10, so that the distance between the centers of the pins 7 and 15 is increased or decreased. The extension detecting unit 20 detects the extension or the contraction of the stretchable boom 13 and gives a detection signal corresponding to the extension or the contraction of the stretchable boom 13 to the counter 59. On the other hand, the hydraulic cylinders 9 are controlled so as to turn the first boom 6 on the pin 7 so that the stretchable boom 13 is inclined at an appropriate inclination to the deck of the vehicle 1. The inclination detector 29 detects the inclination of the stretchable boom 13 and gives a detection signal corresponding to the inclination to the ADC 56.

The CPU 51 calculates the height of the center of the pin 15 from a plane extending in parallel to the upper surface of the deck of the vehicle 1 and containing the center of the pin by Expression (2) by using the detection signal L of the extension detecting unit 20 and the detection signal $\theta$ of the inclination detector 29, and then the CPU 51 compares the calculated value B with a fixed value H (step S207). When the difference between the calculated value B and the fixed value H is smaller than a predetermined value, the routine goes to step S209. At step S209, a decision is made as to whether or not the selector lever 91 is shifted and, when the decision is NO, the routine goes to step S202 and, when YES, the routine goes to step S210, where a decision is made as to whether the selector lever 91 is shifted to the FORWARD-position, the STOP-position or the BACKWARD-position.

When the selector lever 91 is shifted to the STOP-position, the platform 16 is stopped at step S211. When the selector lever 91 is operated at step S212, a decision is made at step S213 as to whether the selector lever 91 is shifted to the FORWARD-position or to the BACKWARD-position. When the selector lever 91 is shifted to the FORWARD-position, a signal indicating that the selector lever 91 is shifted to the FORWARD-position is given to the IRI 57 at step S214, and then at step S215 a decision is made as to whether or not the platform 16 has arrived at the front limit position and, when the decision is YES, the routine goes to step S211 and, when NO, the routine returns to step S202.

On the other hand, when it is decided, at step S213, that the selector lever 91 is shifted to the BACKWARD-position, the routine goes to step S216, where a signal indicating that the selector lever 91 is shifted to the BACKWARD-position is given to the IRI 57. Then, at step S217, a decision is made at step S217 as to whether or not the platform 16 has arrived at the back limit position and, when the decision is YES, the platform 16 is stopped and, when NO, the routine returns to step S202. When a decision that the selector lever 91 is shifted to the FORWARD-position is made at step S210, the routine goes to step S214 and, when a decision that the selector lever 91 is shifted to the BACKWARD-position is made at step S210, the routine goes to step S216.

When a decision that the difference between the calculated value B and the fixed value H is greater than the predetermined value is made at step S208, the routine goes to step S218. At step S218, the CPU 51 gives a command to make the DO 55 provide control signals to control the solenoid valve 72 so that the rate of extension of the stretchable boom is regulated properly and also to control the solenoid valves 79 and 86 so that the inclination of the stretchable boom 13 is regulated properly by the hydraulic cylinders 9; the hydraulic cylinders 18 are controlled accordingly. At step S219, the CPU 51 receives the detection signals of the extension detecting unit 20 and the inclination detector 29 through the counter 59 and the DIO 54 and through the ADC 56, respectively, and then, at step S220, the CPU 51 calculates the height of the center of the pin 15 by the Expression (2) by using the detection signals. At step S221, a decision is made as to whether or not the calculated value B coincides with the fixed value H and, when the decision is YES, the routine goes to step S218 and, when NO, the routine returns to step S202.

The rate of extending the stretchable boom 13 by the hydraulic cylinders 35 and 40 and the rate of turning the stretchable boom 13 by the hydraulic cylinders 9 are matched to each other through a series of the above-mentioned procedures so that the platform 16 is moved in parallel to the upper surface of the deck of the vehicle 1 at the elevated level. Furthermore, since the action of the hydraulic cylinders 18 is matched to that of the hydraulic cylinders 9 so that the angle between the platform 16 and the cover 12 is varied properly according to the variation of the inclination of the stretchable boom 13, the floor of the platform 16 is always held in parallel to the deck of the vehicle 1. Accordingly, the vehicle 1, the stretchable boom 13 and the platform 16 form a configuration having the shape of a letter Z. Upon the arrival of the platform 16 at a desired elevated level, the selector lever 66 is shifted to the STOP-position to hold the operation of the hydraulic cylinders 9, 18, 35 and 40 so that the platform 16 is held at the elevated level for work, such as assembling work, repairing work or painting work, on the elevated level. Furthermore, after the platform 16 has been held at the elevated level, the platform 16 can be moved in parallel to the deck of the vehicle 1, which facilitates work on a plane at an elevated level.

A fourth embodiment of the present invention will be described hereinfter with reference to FIGS. 31 to 41.

The fourth embodiment is capable of moving the platform in vertical directions and horizontal directions between a reference position and a desired position both through manual operation and automatic operation and is also capable of automatically moving the platform in oblique directions between the reference position and a desired position through electronically controlled automatic operation. However, since the mechanical constitution, namely, the vehicle, the power unit, the stretchable boom and the platform, the functions to move the platform in vertical direction or horizontal direction of the fourth embodiment are the same as those of the third embodiment, the description thereof will be omitted to avoid duplication. Furthermore, a hydraulic control system employed in the fourth embodiment is fundamentary the same as third embodiment except that the selector valves of the hydraulic system of the fourth embodiment are controlled electronically and the hydraulic system is provided with an automatic control boad and a control box for controlling the selector valves, and hence the constitution and the components of the hydraulic system of the fourth embodiment which are the same as those of the third embodiment will be described briefly for simplicity.

Figure 37:
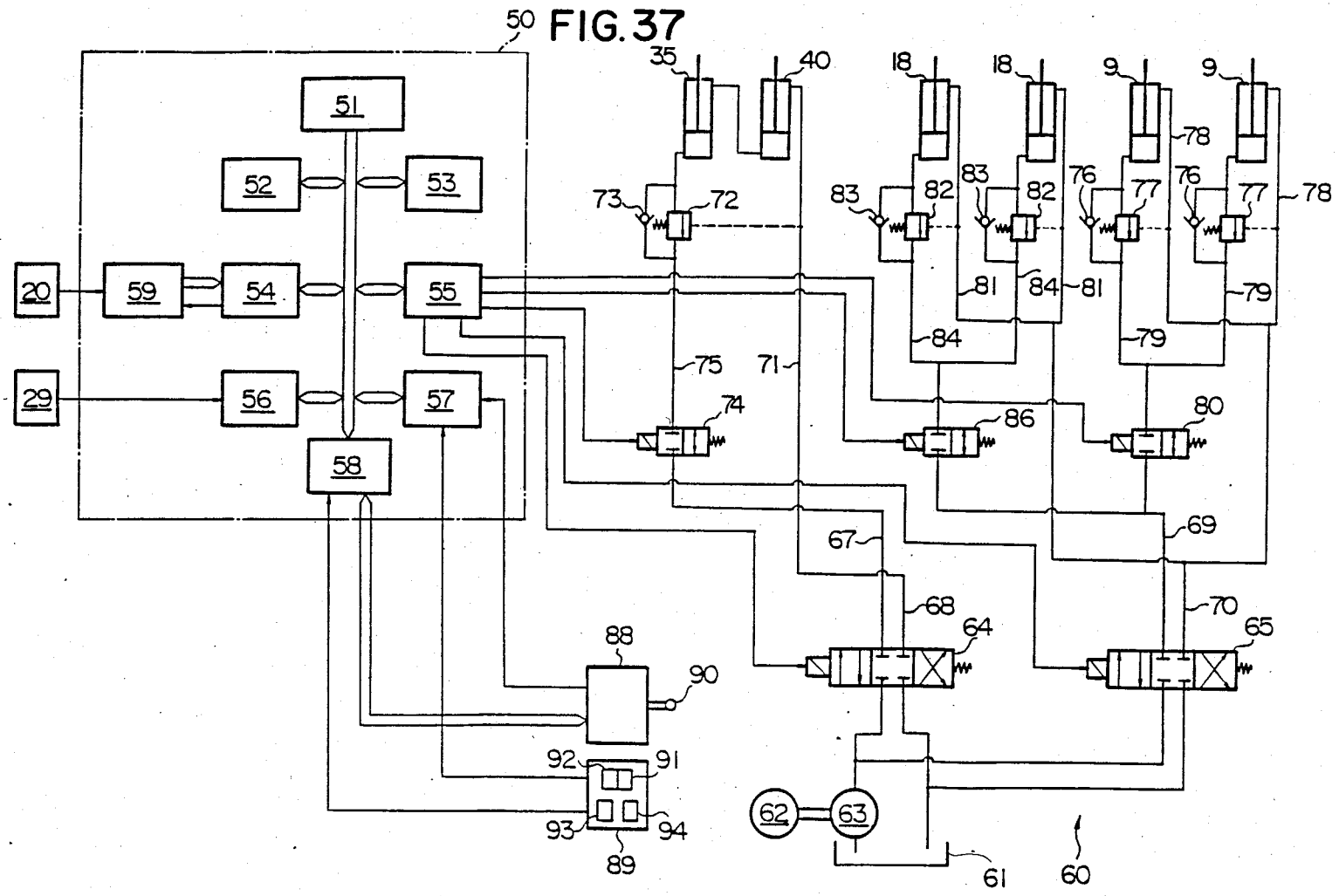
FIG. 37 is a hydralic circuit diagram of a hydralic control system employed in the fourth embodiment of the present invention.

Referring to FIG. 37, a hydraulic control system employed in the fourth embodiment comprises a control circuit 50 and a hydaulic circuit 60.

The control circuit 50 is an electronic microcomputer comprising a CPU 51 for processing data, a ROM 52 storing predetermined control programs and constants, a RAM 53 storing programs to be executed and variables, a DIO 54 which receives digital signals, a DO 55 which sends out digital signals, an ADC 56 which converts analog signals into corresponding digital signals, an IRI 57 which receives interrupt signals, a second DIO 58, a counter 59 connected to the DIO 54 and bus lines interconnecting these devices. The extension detecting unit 20 is connected to the counter 59, while the inclination detector 29 connected to the ADC 56. A control box 88 and automatic control board 89, which will be described later, are connected to the IRI 57 and the DIO 58.

The hydraulic circuit 60 comprises series-connected hydraulic cylinders 35 and 40 for extending and contracting the stretchable boom 13, hydraulic cylinders 18 for turning the platform 16 relative to the stretchable boom 13, hydaulic cylinders 9 for turning the stretchable boom on the pin 7 relative to the vehicle 1, solenoid valves 74, 80 and 86 for regulating the operation of the hydraulic cylinders 35 and 40, the hydraulic cylinders 9 and the hydraulic cylinder 18, respectively, a selector valve 64 which is controlled by the control signal of the DO 55 so as to connect either a line connected to the hydraulic cylinder 35 or a line connected to the hydraulic cylinder 40 to a hydraulic pump 63, a selector valve 65 which is controlled by the control signal of the DO 55 so as to connect either a line 69 connected to one inlet port of each of the hydraulic cylinders 18 and 9 or a line 70 connected to the other port of each of the hydraulic cylinderss 18 and 9 to the hydraulic pump 63, lines interconnecting the components of the hydraulic circuit, the control box 88 with a selector lever having five positions, namely, an UP-position, a DOWN-position, a FORWARD-position, a BACKWARD-position and a STOP-position, and the automatic control board 89 provided with a memory button 91, a mode selection button 92 for selecting the mode of moving the platform 16, an automatic up button 93 and an automatic down button 94. Signals indicating the position of the selector lever 90 are given to the IRI 57 and the DIO 58. Thus, the CPU 51 decides the condition of the control box 88 and the automatic control board 89 and provides commands corresponding to the condition of the control box 88 and the automatic control board 89 to control the solenoid valves 74, 80 and 86 and the selector valves 64 and 65 accordingly.

The function of the fourth embodiment of the present invention will be described hereinafter with reference to FIGS. 31 to 41.

Vertical Movement of the Platform 16:

The manner of vertically moving the platform 16 is substantially the same as the third embodiment. The engine 62 is started to drive the hydraulic pump 63 (step S100), and then the selector lever 90 of the control box 88 is thrown to the UP-position (step S101). A sensor provided in the control box 88 detects the position of the selector lever 90 and gives a signal corresponding to the UP-position through the IRI 57 and the DIO 58 to the CPU 51 (step S102). Then, the CPU 51 gives a command to the DO 55 to set the selector valves 64 and 65 in an appropriate position (step S103) and starts reading the detection signals of the extension detection unit 20 and the inclination detector 29 (step S104), and then the CPU 51 opens the solenoid valves 74, 80 and 86 (step S105). Consequently, the working fluid is supplied through the line 75, the line 79 and the line 84 to the hydraulic cylinders 35 and 40, the hydraulic cylinders 9 and the hydraulic cylinders 18, respectively (step S106) to cause the platform 16 to start raising. As the stretchable boom 13 is extended by the hydraulic cylinders 35 and 40 and is turned on the pin 7 by the hydraulic cylinders 9, the extension detecting unit 20 detects the extension of the stretchable boom 13, while the inclination detector 29 detects the inclination of the stretchable boom 13 and give detection signals corresponding to the extension and the inclination of the stretchable boom 13 to the CPU 51 through the counter 59 and the DIO 54 and through the ADC 56, respectively. Then, the CPU calculates the horizontal distance between the centers of the pins 7 and 15 by Expresssion (1) by using the detection signals of the extension detecting unit 20 and the inclination detector 29, and then compares the calculated value A with a fixed value C, namely, the distance between the centers of the pins 7 and 15 when the stretchable boom 13 is fully contracted and the platform 16 is lowered to the lowermost position (step S108). When the difference between the calculated value A and the fixed value C is smaller than a predetermined value, the routine goes to step S109. At step S109, a decision is made as to whether or not the selector lever 90 is shifted and, when the decision is NO, the routine goes to step S110, where the existing position of the selector lever 90, namely, the UP-position, the STOP-position or the DOWN-position is decided.

When the selector lever 90 is at the STOP-position at step S110, the selector valves 64 and 65 are shifted to STOP-position to stop the platform 16. When the selector lever 90 is operated at step S112, a decision is made at step S113 as to whether or not the selector lever 90 is shifted to the UP-position; when the decision is YES, the routine goes to step S114 and a signal indicating that the selector lever 90 is shifted to the UP-position is given to the IRI 57 and the DIO 58. Then, at step S115, a decision is made as to whether or not the platform 16 has arrived at the uppermost position and, when the decision is YES, the routine goes to step S111 and, when NO, the selector valves 64 and 65 are shifted to the UP-position (step S116) and the routine goes to step S104. On the other hand, when the selector lever 90 is found to be at the DOWN-position at step S113, the routine goes to step S117, where a signal indicating that the selector lever 90 is shifted to the DOWN-position is given to the IRI 57 and the DIO 58, and then a decision is made as to whether or not the platform 16 has arrived at the lowermost position; when the decision is YES, the selector valves 64 and 65 are shifted to the STOP-position to stop the platform 16 and the control routine is completed and, when NO, the selector valves 64 and 65 are shifted to the DOWN-position (step S119) and the routine returns to step S104. When the selector lever 90 is at the UP-position at step S110 the routine goes to step S114 and, when at the DOWN-position, the routine goes to step S117.

When the difference between the calculated value A and the fixed value C is found to be greater than the predetermined value at step S108, the routine goes to step S120, where the CPU 51 gives a command to the DO 55 to regulate the rate of extension or contraction of the stretchable boom 13 properly by the solenoid valve 74 and to regulate the rate of turning the stretchable boom 13 on the pin 7 properly by the solenoid valve 80. At the same time, the hydraulic cylinders 18 are controlled through the solenoid valve 86 so that the platform 16 is kept in parallel to the deck of the vehicle. At step S121, the CPU 51 receives the detection signals of the extension detecting unit 20 and the inclination detector 29 through the counter 59 and the DIO 54 and through the ADC 56, respectively, and calculates the horizontal distance betweeen the centers of the pins 7 and 15 by Expression (1) by using the detection signals. At step S122, a decision is made as to whether or not the calculated value A coincides with the fixed value C and, when the dicision is NO, the routine goes to step S120 and, when YES, the routine returns to step S104.

Upon the arrival of the platform 16 at a desired elevated level, the selector lever 90 is shifted to the STOP-position to shift the selector valves 64 and 65 to the STOP-position so that the operation of the hydraulic cylinders 9, 18, 35 and 40 are stopped to hold the platform 16 at the elevated level (steps S108 and S110) for work, such as assembling work, repairing work or painting work, on the elevated level. If the memeory button 91 of the automatic control board 89 is pushed with the platform 16 held at the elevated level, the existing height H of the platform 16 is stored in the RAM 53.

To lower the platform 16, the selector lever 90 is thrown to the DOWN-position at step S112. Then, the platform 16 is lowered to the lowermost position in the same procedure as the third embodiment.

Figure 39:
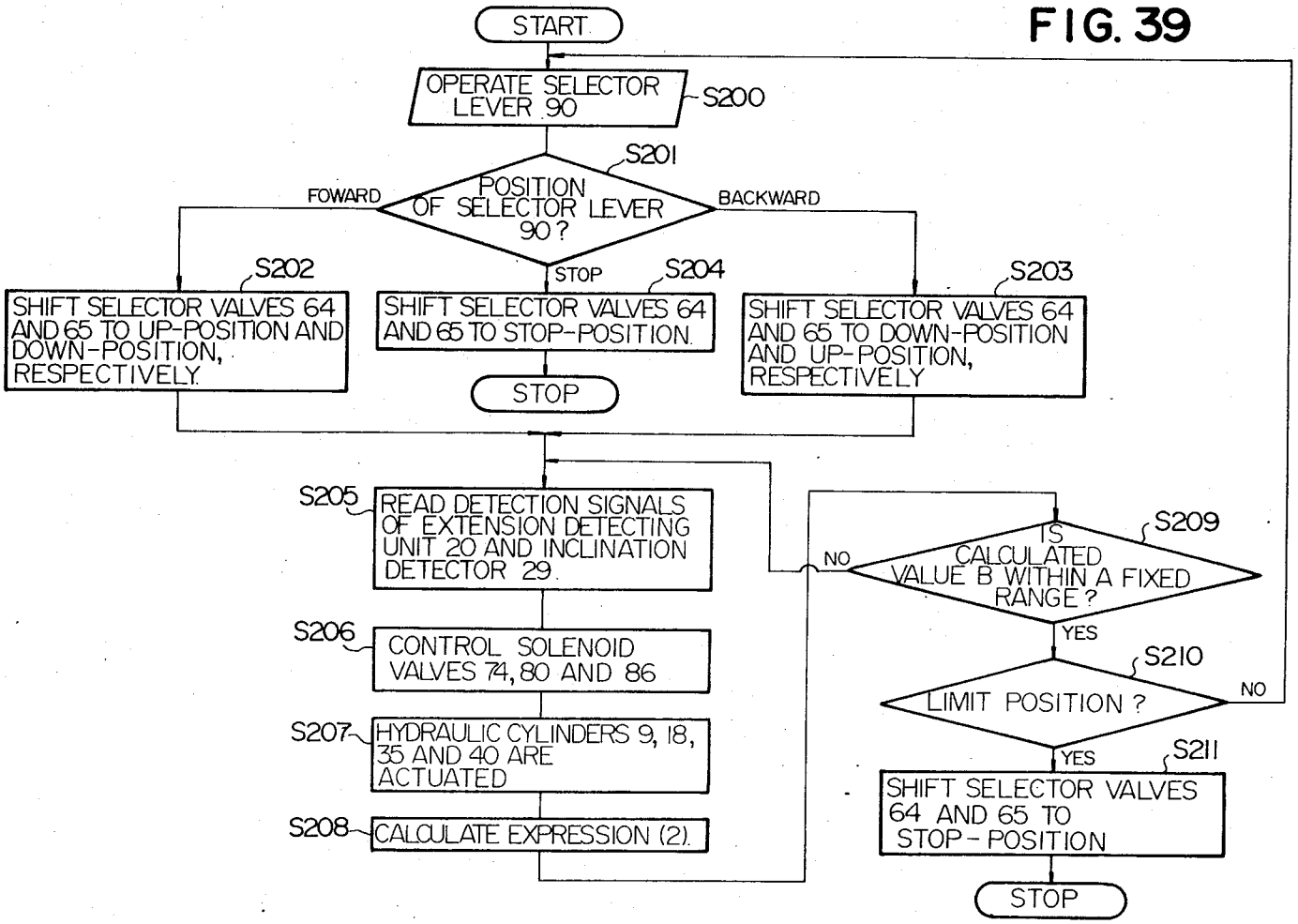
FIG. 39 is a flow chart of a control progam for controlling the operation of the lifting aparatus of FIG. 31 to move the platform manually in horizontal direction.

Horizontal Movement of the Platform 16 at a Level Ho:

Manner of moving the platform 16 forwad or backward at a fixed level Ho will be described hereinafter with reference to FIG. 39.

At step S200, the selector lever 90 of the control box 88 is thrown to the FORWARD-position or the BACKWARD-position. At step S201, the position of the selector lever 90 is decided, and then the routine goes to step S202, step S203 or step S204 when the selector lever is shifted to the FORWARD-position, the BACKWARD-position or the STOP-position, respectively. The CPU 51 shifts the selector valves 64 and 65 through the DO 55 to the UP-position and the DOWN-position, to the DOWN-position and the UP-position or to the STOP-position at step S202, step S203 or step S204, respectively. Then, at step S205, the CPU 51 reads and the RAM 53 stores the detection signals of the extension detecting unit 20 and the inclination detector 29. At step S206, the solenoid valves 74, 80 and 86 are controlled and the working fluid is supplied to the hydraulic cylinders 9, 18, 35 and 40 at step S207. At step S208, the CPU 51 calculates the height of the pin 15, namely, the vertical distance between the centers of the pins 7 and 15, by Expression (2) by using the detection signals of the extensin detecting unit 20 and the inclination detector 29. At step S209, a decision is made as to whether or not the difference between the caluculated value B and the fixed value Ho is within a fixed range and, when the decision is YES, the routine goes to step S210 and, when NO, the routine returns to step S205 to repeat steps S205 to S209. At step S210, a decision is made as to whether or not the platform 16 is moved to the front limit position for the fixed value Ho and, when the decision is YES, the routine goes to step S211, where the CPU 51 shifts the selector valves 64 and 65 to the STOP-position to stop the platform 16. In this state, the center of the pin 15 is positioned at the fixed height Ho and at the maximum horizontal distance lm from the center of the pin 7 for the hight Ho. When it is decided that the platform 16 has not yet been moved to the front limit position at step S210, a series of the steps S200 to S210 are repeated.

Thus, the platform 16 is shifted in a horizontal direction, more exactly, in parallel to the upper surface of the deck of the vehicle 1, on a fixed elevated level through steps S200 to S210. If the memory button 91 of the automatic control board 89 is pushed at step S204 or S211 the horizontal position of the platform 16, namely, the horizontal distance lo of the center of the pin 15 from the center of the pin 7 at the moment when the memory button 91 is pushed, is stored in the RAM 53.

Figure 40:
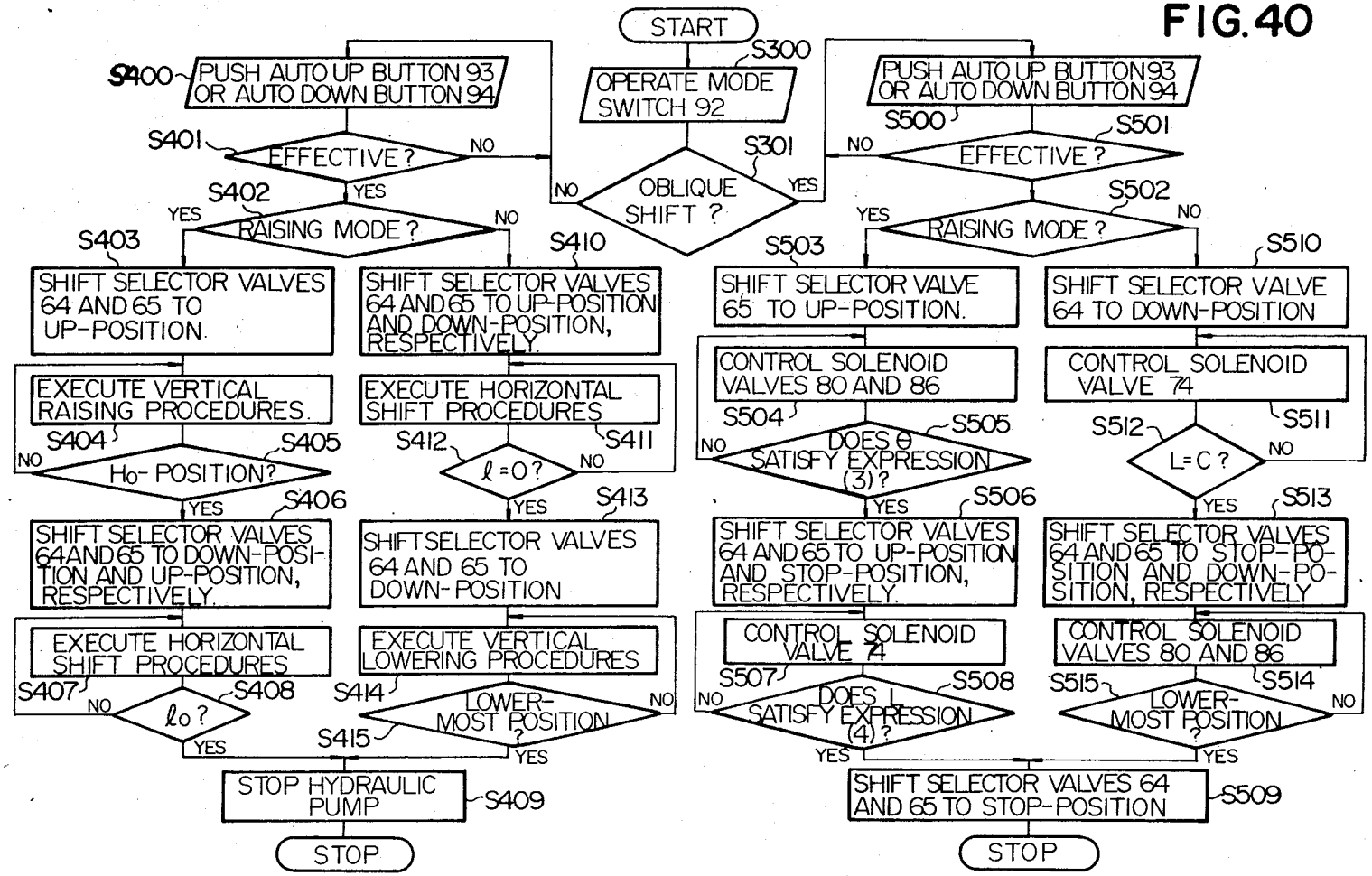
FIG. 40 is a flow chart of a control program for controlling the automatic operation of the lifting apparatus of FIG. 31.
Figure 41:
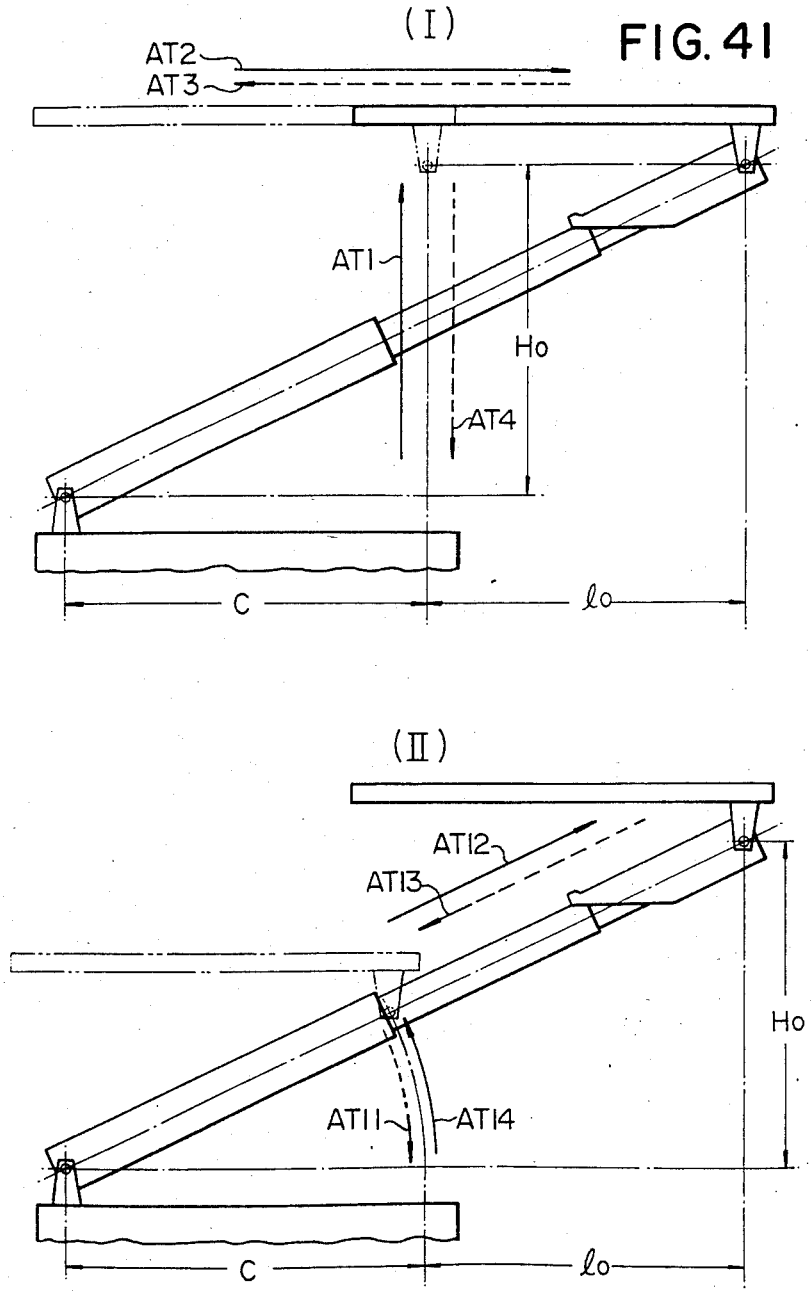
FIG. 41A and 41B are illustrations of assistance in explaining the mode of operation of the lifting apparatus of FIG. 31 according to the control program of FIG. 40.

The automatic operation of the platform 16 will be described hereinafter with reference to FIGS. 40, 41A and 41B, in which the platform 16 is moved automatically between the reference position and the position (lo, Ho) stored in the RAM 53.

At step S300, the mode 92 of the automatic control board 89 is operated to select the mode of moving the platform 16, and then a decision is made at step S301 as to whether or not the operating mode is an oblique shift mode. When the decision at step S301 is YES, the routine goes to step S500 and, when NO, the routine goes to step S400.

Supposed that either an automatic up button 93 or an automatic down button 94 is pushed at step S400. Then the routine returns to step S400 when the operation of the automatic up button 93 or the automaic down button 94 is ineffective. When the platform 16 is located at the reference position, namely, at the lowermost position with the stretchable boom 13 fully contracted, and the automatic up button 93 is pushed, the routine advances through steps S401 and S402 to step S403. At step S403, the selector valves 64 and 65 are shifted to the UP-position, and then the platform raising procedures are executed at step S404, which corresponds to steps S104 to S114 of FIG. 8. At step S405, a decision is made as to whether or not the height of the center of the pin 15 coincides with the stored height Ho and, when the decision is NO, the routine returns to step S404 and, when YES, the routine goes to step S406. At step S406, the CPU 51 shifts the selector valves 64 and 65 to the DOWN-position and the UP-position, respectively. Then, at step S407, steps S205 to S209 of FIG. 39 are executed. When the decision at step S209 is YES, a decision is made at step S408 as to whether or not the horizontal distance of the center of the pin 15 from the center of the pin 7 coincides with the stored distance lo; when the decision is NO, the routine returns to step S407 and, when YES, the routine goes to step S409, where the selector valves 64 and 65 are shifted to the STOP-position to stop the platform 16. The movement of the platform 16 through steps S403 to S405 coresponds to movement AT1 indicated in FIG. 41A, while the movement of the same through steps S406 to S408 corresponds to movement AT2 indicated in FIG. 41A. Thus the platform 16 is automatically raised vertically and then shifted horizontally to an oblique position with respect to the vehicle 1.

Figure 38:
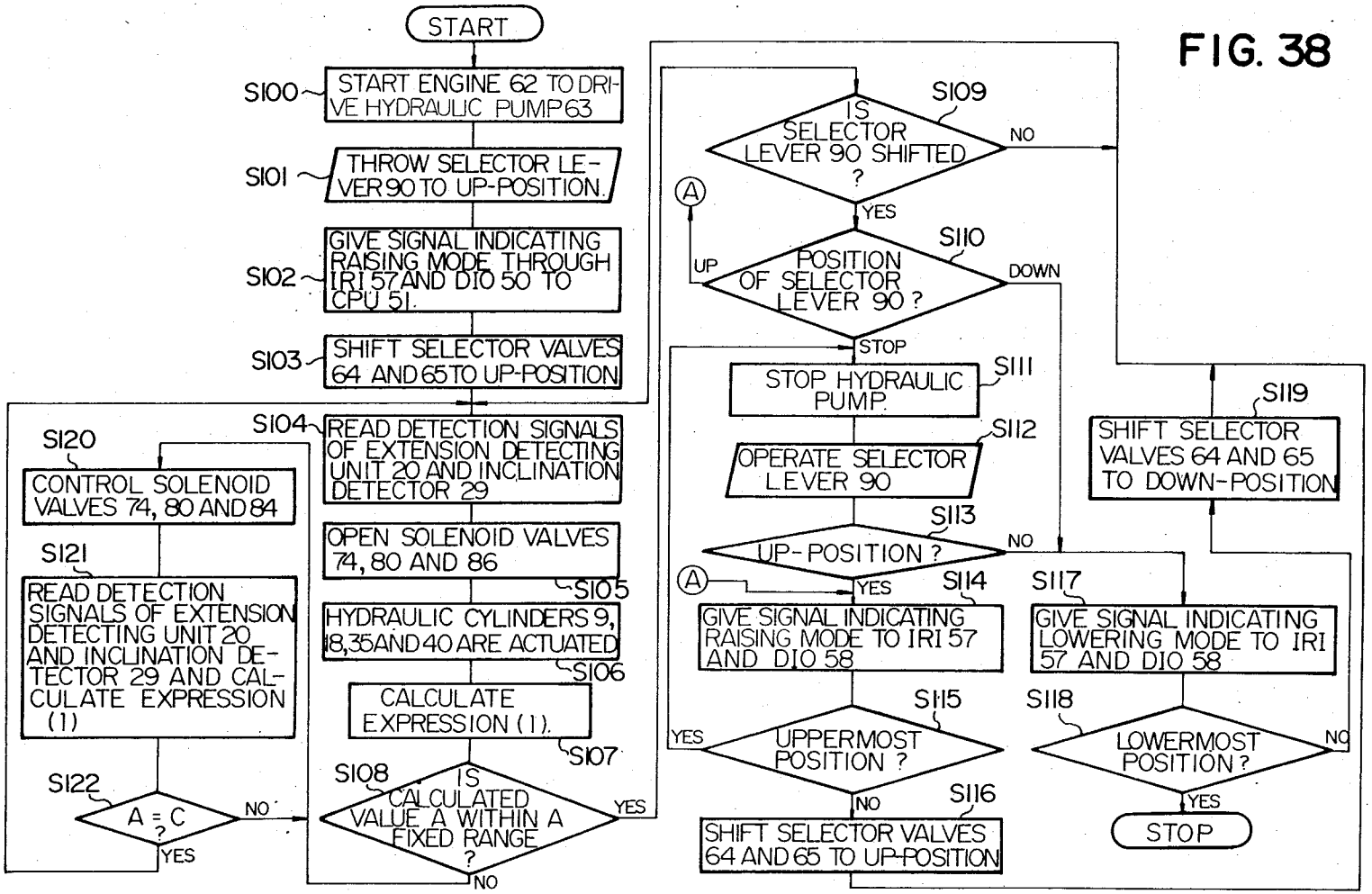
FIG. 38 is a flow chart of a control program for controlling the operation of the lifting aparatus of FIG. 31 to move the platform manually in vertical direction.

The automatic operation of moving the platform 16 from an oblique position (lo, Ho) down to the reference position will be described hereinafter. Supposed that the platform 16 is located at a position corresponding to the stored position (lo, Ho) and the decision at step S402 is NO. Then, the routine goes to step S410. At step S410, the CPU 51 shifts the selector valves 64 and 65 to the DOWN-position and to the UP-position, respectively. Then, at step S411, steps S205 to S209 of FIG. 39 are executed. When the decision at step S209 is YES, the routine goes to step S412, where a decision is made as to whether or not the horizontal distance l between the center of the pins 7 and 15 conincides with the fixed value C and, when the decision is NO, the routine returns to step S411 and, when YES, the routine goes to step S413. At step S413, the CPU 51 shifts the selector valves 64 and 65 to the DOWN-position, and then the routine goes to step S414, where steps S120 to 122 of FIG. 38 are executed. When the decision at step S122 is YES, the routine goes to step S415, where a decision is made as to whether or not the platform 16 has been lowered to the lowermost position; when the decision is NO, the routine returns to step S414 and, when YES, the routine goes to step S409 to shift the selector valves 64 and 65 to the STOP-position. The movement of the platform 16 through steps S410 to S412 corresponds to movement AT13 indicated in FIG. 41A, while the movement through steps S413 to S415 corresponds to movement AT4 indicated in FIG. 41A.

The manner of operation for the oblique shift of the platform 16 will be described hereinafter.

When the decision at step S301 is YES, namely, when the oblique shift mode is selected at step S300, the routine goes to step S500. Supposed that the automatic up button 93 or the automatic down button 94 is pushed at step S500. Then, at step S501, a decision is made as to whether or not the operation of the automatic up button 93 or the automatic down button 94 is effective and, when NO, the routine returns to step S500. Pushing the automatic up button 93 is effective when the platform 16 is located at the lowermost position with the stretchable boom 13 fully contracted. In this case, at step S503, only the selector valve 65 is shifted to the UP-position and the solenoid valves 80 and 86 are controlled at step S504. And then, at step S505, a decision is made as to whether or not the incliantion of the stretchable boom 13 coincides with an inclination A calculated by Expression (3):

$$\theta A = \tan^{-1}\{Ho/(C+lo)\} \quad (3)$$

where lo is the stored horizontal distance between the centers of the pins 7 and 15 and Ho is the stored vertical distance between the centres of the pins 7 and 15. When the decision at step S505 is NO, the routine returns to step S504 and, when YES, the routine goes to step S506. At step S506, the selector valves 64 and 65 are shifted to the UP-position and to the STOP-position, respectively. Then, the solenoid valve 74 is opened to extend the stretchable boom 13. At step S508, the length L of the stretchable boom 13, more exactly, the distance between the centers of the pins 7 ad 15, is compared with a value LA defined by Expression (4):

$$LA = \sqrt{(C + lo)^2 + Ho^2} \quad (4)$$

and when L≠LA, the routines returns to step S507 and when L=LA, the routine goes to step S509, where the selector valve 64 is shifted to the STOP-position to stop the plaform 16.

In FIG. 41B, movement AT14 and movement AT12 correspond to the movement of the platform 16 through steps S503 to S505 and through steps S506 to S508, respectively. Thus, the platform 16 is raised obliquely up to the elevated position stored in the RAM 53.

The manner of operation for lowering the platform 16 from an oblique position to the reference position will be described hereinafter.

When the automatic down button 94 is pushed with the platform 16 at an obliquely elevated position at step S500, pushing the automatic down button 94 is effective. At step S502, it is decided that the automatic down operation is instructed, and then the routine goes to step S510. At step S510, only the selector valve 64 is shifted to the DOWN-position and, at step S511, the solenoid valve 74 is opened. At step S512, a decision is made as to whether or not the length of L the stretchable boom 13, more exactly, the distance between the centers of the pins 7 and 15, detected by means of the extension detecting unit 20 coincides with the fixed value C and, when the decision is no, the routine returns to step S511 and, when YES, the routine goes to step S513. At step S513, the selector valves 64 and 65 are shifted to the STOP-position and DOWN-position, respectively. At step S510, the solenoid valves 80 and 86 are opened. When it is decided, at step S515, that the platform 16 has been lowered to the lowermost position with the stretchable boom 13 fully contracted, the routine goes to step S509 and, when not, the routine returns to step S514. In FIG. 41B, movement AT13 and movement AT11 correspond to the movement of the platform 16 through steps S510 to S512 and through steps S513 to S515, respectively. Thus the platform 16 is lowered obliquely.

The fourth embodiment of the present invention is capable of automatically moving the platform 16 between the refeence position and an oblique elevated position stored in the memory both via an oblique passage and via successive vertical and horizontal passages or successive horizontal and vertical pasages, which facilitates the repeated movement of the platform 16 between the reference position and a fixed obliquie elevated position.

Although the invention has been described with reference to the preferred embodiments thereof with a certain degree of particularity, it is to be understood that many changes and variations are possible in the invention without departing from te scope and spirit thereof.

What is claimed is:

1. A lifting apparatus comprising:

(a) a mobile vehicle;

(b) a platform disposed over said mobile vehicle;

(c) a stretchable boom pivotally joined at the lower end thereof with a pin to said mobile vehicle and at the upper end thereof with a pin to said platform, for raising or lowering said platform relative to said mobile vehicle;

said stretchable boom comprising a lowermost boom pivotally joined to said mobile vehicle with the pin, an uppermost boom pivotally joined to said platform with the pin, and a plurality of intermediate booms slidably inserted one in another in a telescopic fashion with the lowermost intermediate boom slidably inserted in said lowermost boom and said uppermost intermediate boom inserted in and fixed to said uppermost boom;

(d) an extension detecting unit for detecting the existing length, of said stretchable boom represented by the center distance between the pin pivotally joining the stretchable boom to said mobile vehicle and the pin pivotally joining said stretchable boom to said platform;

(e) an inclination detector for detecting the existing inclination of said stretchable boom;

(f) a hydraulic control system comprising a control circuit and a hydraulic circuit;

said control circuit being capable of controlling the operation of the hydraulic circuit on the basis of the detection signals given thereto from said extension detecting unit and said inclination detector so that said platform is raised or lowered vertically with respect to and directly above said mobile vehicle and so that said platform is always held in parallel to the upper surface of the deck of said mobile vehicle; and (g) a power unit including a hydraulic pump for supplying the pressurized working fluid to said hydraulic circuit, and driving means for driving said hydraulic pump, and mounted on said mobile vehicle.

2. A lifting apparatus according to claim 1, wherein said hydraulic circuit comprises:

(a) a tank containing the working fluid;

(b) a hydraulic pump for supplying said working fluid to said hydraulic cirucit;

(c) hydraulic clylinders for extending or contracting said stretchable boom;

(d) hydraulic cylinders for varying the inclination of said stretchable boom;

(e) hydraulic cylinders for varying the angle between said stretchable boom and said platform;

(f) a selector valve for selectively supplying said working fluid to said hydraulic cylinders and having a selector lever for selectively shifting valve position of said selector valve;

(g) solenoid valves for regulating the operation of said hydraulic cylinders; and (h) piping properly interconnecting the components of said hydraulic circuit.

3. A lifting apparatus according to claim 2, wherein said solenoid valves are ON-OFF solenoid valves, and said selector valves are electomagnetic three-position selector valves.

4. A lifting apparatus according to claim 1, wherein said control circuit comprises:

(a) an arithmetic data processing unit;

(b) a read-only memory for storing predetermined control programs and constants;

(c) a random access memory for storing control programs to be executed and variables;

(d) a digital signal input-output device;

(e) an analog-to-digital converter connected to said inclination detector;

(f) a counter connected to said extension detecting unit and to said digital input-output device;

(g) an interrupt input device which receives interrupt signals;

(h) a driving sensor electrically connected to said selector lever and to said interrupt input device, for detecting the valve position of said selector valve and for giving a signal corresponding to the valve position of said selector valve to said interrupt input device of said control circuit; and (i) bus lines properly interconnecting the components of said control circuit.

5. A lifting apparatus according to claim 1, wherein said control circuit calculates the horizontal distance between the centers of the pin pivotally joining said stretchable boom to said mobile vehicle and the pin pivotally joining said stretchable boom to said platform, by an expression $A = Ln \cdot \cos\theta\, n$, where Ln is the center distance between the pins corresponding to the detection signal of said extension detecting unit, and $\theta$ n is the inclination of the stretchable boom corresponding to the detection signal of said inclination detector, and then said control circuit controls said hydraulic circuit according to the detection signals of said extension detecting unit and said inclination detector so that the difference between the calculated value A and a fixed value C corresponding to the center distance between the pins pivotally joining said stretchable boom to said mobile vehicle and to said platform, respectively when said stretchable boom is fully contracted, is always smaller than a predetermined value and so that said platform is always held in parallel to the upper surface of the deck of said mobile vehicle as the same is raised or lowered vertically.

6. A lifting apparatus according to claim 1, wherein said extension detecting unit comprises:

(a) a base fixed to said uppermost boom;

(b) a rotary shaft rotatably supported on said base;

(c) a tape fixed at one end to said rotary shaft and at the other end to said lowermost boom, and wound on said rotary shaft so as to be extended and retracted as said stretchable boom is extended and contracted, respectively;

(d) a digital encoder coupled with said rotary shaft and electrically connected to said counter of said control circuit; and (e) a cover covering said rotary shaft and said digital encoder.

7. A lifting apparatus according to claim 1, wherein said inclination detector is a potensiometer.

8. A lifting apparatus comprising:

(a) a mobile vehicle;

(b) a platform disposed over said mobile vehicle;

(c) a stretchable boom pivotally joined at the lower end thereof with a pin to said mobile vehicle and at the upper end thereof with a pin to said platform, for raising or lowering said platform relative to said mobile vehicle; said stretchable boom comprising a lowermost boom pivotally joined to said mobile vehicle with the pin, an uppermost boom pivotally joined to said platform with the pin, and a plurality of intermediate booms slidably inserted one in another in a telescopic fashion with said lowermost intermediate boom slidably inserted in said lowermost boom and said upper most intermediate boom inserted in and fixed to said uppermost boom;

(d) an extension detecting unit for detecting the existing length of said stretchable boom represented by the center distance between the pin pivotally joining said stretchable boom to said platform;

(e) an inclination detector for detecting the existing inclination of said stretchble boom;

(f) a hydraulic control system comprising a control circuit and a hydraulic circuit; and (g) a power unit including a hydraulic pump for supplying the pressurized working fluid to said hydraulic circuit, and driving means for driving said hydraulic pump, and mounted on said mobile vehicle;

said control cirucit being capable of controlling the operation of the hydraulic cirucit on the basis of the detection signals given thereto from said extension detecting unit and said inclination detector so that said platform is raised or lowered vertically with respect to and directly above said mobile vehicle, so that said platform is raised or lowered vertically in front of said mobile vehicle and so that said platform is always held in parallel to the upper surface of the deck of said mobile vehicle.

9. A lifting apparatus according to claim 8, wherein aid hydraulic circuit comprises:

(a) a tank containing the working fluid;

(b) a hydraulic pump for supplying the working fluid to said hydraulic circuit;

(c) hydraulic cylinders for extending or contracting said stretchable boom;

(d) hydraulic cylinders for varying the inclination of said stretchable boom;

(e) hydraulic cylinders for varying the angle between th stretchable boom and said platform;

(f) a selector valve for selectively supplying the working fluid to said hydraulic cylinders, and having a selector lever for selectively shifting the valve position of said selector valve;

(g) solenoid valves for regulating the operation of said hydraulic cylinders; and (h) piping properly internconnecting the components of said hydraulic circuit.

10. A lifting apparatus according to claim 9, wherein said solenoid valves are ON-OFF solenoid valves, and said selector valves are electromagnetic three-position selector valves.

11. A lifting apparatus according to claim 8, wherein said control circuit comprises;

(a) an arithmetic data processing unit;

(b) a read-only memory for storing predetermined control programs and constants;

(c) a random access memory for storing control programs to be executed and variables;

(d) a digital signal input-output device;

(e) a digital signal output device;

(f) an analog-to-digital converter connected to said inclination detector;

(g) a counter connected to the extension detecting unit and to said digital input-output device;

(h) an interrupt input device which receives interrupt signals; a driving sensor electrically connected to said selector lever and to said interrupt input device, for detecting the valve position of said selector valve and for giving a signal corresponding to the valve position of said selector valve to the interrupt input device of said control cirucit;

(i) extension control means which gives a signal indicating that only said hydraulic cylinders for extending or contracting said stretchable boom are to be actuated to extend said stretchable boom forward to said interrupt input device; and (j) bus lines properly interconnecting the components of said control circuit.

12. A lifting apparatus according to claim 8, wherein said control circuit calculates the horizontal distance between the centers of the pin pivotally joining the stretchable boom to said mobile vehicle and the pin pivotally joining said stretchable boom to said platform, by an expression $A = Ln \cdot \cos \theta n$, where Ln is the center distance between the pins corresponding to the detection signal of the extension detecting unit, and $\theta n$ is the inclination of said stretchable boom corresponding to the detection signal of said inclination detector, and then said control circuit controls said hydraulic circuit according to the detection signals of said extension detecting unit and said inclination detector so that the difference between the calculated value A and a fixed value C corresponding to the center distance between the pins pivotally joining the stretchable boom to said mobile vehicle and tsaid platform, respectively, when said stretchable boom is fully contracted, or the difference between the calculated value A and a predetermined value C+D, where D ia an optional value meeting a condition depending on the maximum center distance between the pins and a desired level to which said platform is to be raised, is always smaller than a predetermined value and so that said platform is always held in parallel to the upper surface of the deck of said mobile vehicle as the same is raised or lowered.

13. A lifting apparatus according to claim 8, wherein said extension detecting unit comprises:

(a) a base fixed to said uppermost boom;

(b) a rotary shaft rotatably supported on said base;

(c) a tape fixed at one end to said rotary shaft and at the other end to said lowermost boom, and wound on said rotary shaft so as to be extended and retracted as said stretchable boom is extended and contracted respectively;

(d) a digital encoder coupled with said rotary shaft and electrically connected to said counter of said control circuit; and (e) a cover covering said rotary shaft and said digital encoder.

14. A lifting apparatus according to claim 8, wherein said inclination detector is a potentiometer.

15. A lifting apparatus comprising:

(a) a mobile vehicle;

(b) a platform disposed over said mobile vehicle;

(c) a stretchable boom pivotally joined at the lower end thereof with a pin to said mobile vehicle and at the upper end thereof with a pin to said platform, for raising or lowering said platform relative to said mobile vehicle; said stretchable boom comprising a lowermost boom pivotally joined to said mobile vehicle with the pin, an uppermost boom pivotally joined to said platform with the pin, and a pluraity of intermediate booms slidably inserted one in another in telescopic fashion with said lowermost intermediate boom slidably inserted in said lowermost boom and said uppermost intermediate boom inserted in and fixed to said uppermost boom;

(d) an extension detecting unit for detecting the existing length of said stretchable boom represented by the center distance between the pin pivotally joining said stretchable boom to said mobile vehicle and the pin pivotally joining the stretchable boom to said platform;

(e) an inclination detector for detecting said existing inclination of said stretchable boom;

(f) a hydraulic control system comprising a control circuit and a hydraulic circuit;

said control circuit being capable of controlling the operation of said hydraulic cirucit on the basis of said detecting signals given thereto from said extension detecting unit and said inclination detector so that said platform is raised or lowered vertically with respect to and directly above said mobile vehicle, so that said platform is shifted horizontally on an elevated level and so that said platform is always held in parallel to the upper surface of the deck of said mobile vehicle; and (g) a power unit including a hydraulic pump for supplying the pressurized working fluid to said hydraulic circuit, and driving means for driving said hydraulic pump, and mounted on said mobile vehicle.

16. A lifting apparatus according to claim 15, wherein said hydraulic circuit comprises:

(a) a tank containing the working fluid;
(b) a hydraulic pump for supplying the working fluid to said hydraulic circuit;
(c) hydraulic cylinders for extending or contrcting said stretchable boom;
(d) hydraulic cylinders for varying the inclination of said stretchable boom;
(e) hydraulic cylinders for varying the angle between said stretchable boom and said platform;
(f) a first selector valve for selevetively supplying the working fluid to said hydraulic cylinders, for vertically moveing said platform, and having a first selector lever for selectively shifting the valve position of said first selector valve;
(g) a second selector valve for supplying the working fluid to said hydraulic cylinders, for horizontally moving said platform, and having a second selector lever for selectively shifting the valve position of said second selector valve;
(h) solenoid valves for regulating the operation of the hydraulic cylinders; and
(i) piping properly internconnecting the components of said hydraulic circuit.

17. A lifting apparatus according to claim 16, wherein said solenoid valves are ON-OFF solenoid valves, and said selector vales are electromagnetic three-position selector valves.

18. A lifting apparatus according to claim 15, wherein said control circuit comprises:

(a) an arithmetic data processing unit;
(b) a read-only memory for storing predetermined control programs and constants;
(c) a random access memory for storing control programs to be executed and variables;
(d) a digital signal input-output device;
(e) a digital signal output device;
(f) an analog-to-digital converter connected to said inlication detector;
(g) a counter connected to said extension detecting unit and to said digital input-output device;
(h) an interrupt input device which receives interrupt signals;
(i) a first driving sensor electrically connected to said first selector lever and to said interrupt input device, for detecting the valve position of said first selector valve and for giving a signal corresponding to the valve position of said first selector valve to said interrupt input device of said control circuit;
(j) a second driving sensor electrically connected to said second selector lever and to said interrupt input device, for detecting the valve position of said second selector valve and giving a signal corresponding to the valve position of said second selector valve to said interrupt input device of said control circuit;
(k) extenstion control means which gives a signal indicating that only said hydraulic cylinders for extending or contracting said stretchable boom are to be actuated to said interrupt input device; and
(l) bus lines properly interconnecting the components of said control circuit.

19. A lifting apparatus according to claim 15, wherein first and second selector valves are interlocked mechanically to inhibit the simultaneous operation of said first and second selector valves.

20. A lifting apparatus according to claim 15, wherein said control circuit calculates, in rasing or lowering said platform vertically with respect to and directly above said mobile vehicle, the horizontal distance between the cernters of the pin pivotally joining the stretchable boom to said mobile vehicle and the pin pivotally joining the stretchable boom to said platform, by an expression: $A=Ln\cdot\cos\theta n$, where Ln is the center distance between the pins corresponding to the detection signal of said extension detecting unit, and $\theta n$ is the inclination of said stretchable boom corresponding to the detection signal of said inclination detector, and then said control circuit controls said hydraulic circuit according to the detection signals of said extension detecting unit and said inclination detector so that the difference between the calculated value A and a fixed value C corresponding to the center distance between the pins pivotally joining the stretchable boom to said mobile vehicle and said platform, respectively, when said stretchable boom is fully contracted, is always smaller than a predetermined value and so that said platform is always held in parallel to the upper surface of the deck of said mobile vehicle, or calculates, in horizontally shifting said platform on an elevated level, the vertical center distance betweend the pins pivotally joining the stretchable boom to said mobile vehicle and said platform, by an expression: $B=Ln\cdot\sin\theta n$, where Ln is the center distance between the pins corresponding to the detection signal of said extension detecting unit, and $\theta n$ is the inclination of said stretchable boom corresponding to the detection signal of said inclination detector, and then said control circuit controls said hydraulic cirucit so that the difference between the calculated value B and the height Ho of the elevated level is always smaller than a predetermined value and so that said platform is always held in parallel to the upper surface of the deck of said mobile vehicle.

21. A lifting apparatus according to claim 15, wherein said extension detecting unit comprises:

(a) a base fixed to said uppermost boom;
(b) a rotary shaft rotatably supported on said base;
(c) a tape fixed at one end to said rotary shaft and at the other end to said lowermost boom, and wound on said rotary shaft so as to be extended and retacted as said stretchable boom is extended and contracted, respectively;
(d) a digital encoder coupled with said rotary shaft and electrically connected to said counter of said control circuit; and
(e) a cover covering said rotary shaft and said digital encoder.

22. A lifting apparatus according to claim 15, wherein, said inclination detector is a potentiometer.

23. A lifting apparatus comprising:

(a) a mobile vehicle;
(b) a platform disposed over said mobile vehicle;
(c) a stretchable boom pivotally joined at the lower end thereof with a pin to said mobile vehicle and at the upper end thereof with a pin to said platform, for raising or lowering said platform relative to said mobile vehicle;

said stretchable boom comprising a lowermost boom pivotally joined to said mobile vehicle with the pin, an uppermost boom pivotally joined to said platform with the pin, and a pluraity of intermediate booms slidably inserted one in another in a telescopic fashion with said lowermost intemediate boom slidably inserted in said lowermost boom and said uppermost intermediate boom inserted in and fixed to said uppermost boom;

(d) an extension detecting unit for detecting the existing length of said stretchable boom represented by the center distance between the pin pivotally joining said stretchable boom to said mobile vehicle and the pin pivotally joining said stretchable boom to said platform;

(e) an inclination detector for detecting the existing inclination of said stretchable boom;

(f) a hydraulic control system comprising a control circuit and a hydralic circuit;

(g) and a power unit including a hydraulic pump for supplying the pressurized working fluid to said hydraulic circuit, and driving means for driving said hydraulic pump, and mounted on said mobile vehicle;

said control circuit being capable of automatically moving said platform from the original position to a recorded oblique position first by vertically raising said platform from the original position to an elevated, level corresponding to the recorded oblique position secondly by horizontally shifting said platform to a horizontal position corresponding to the recorded oblique position, capable of automatically moving said platform from the recorded oblique position to the original position first by shifting said platform from the oblique position to a vertical position corresponding to the recorded to the recorded oblique position and directly above said mobile vehicle and secondly by vertically lowering said platfrorm to the original position, capable of automatically and obliquely moving said platform from the original position to the recorded oblique position by first turning said stretchable boom from the original position to a position where the inclination of said stretchable boom is the same as the inclination of said stretchable boom when the pin joining said stretchable boom to said platform is moved to the recorded oblique position and secondly by extending said stretchable boom so that the pin joining said stretchable boom to said platform reaches the recorded oblique position, capable of automatically and obliquely lowering said platform from the recorded oblique position to the original position first by fully contracting said stretchable boom and secondly turning said stretchable boom to the original position, and capable of always holding said platform in parallel to the upper surface of the deck of said mobile vehicle.

24. A lifting apparatus according to claim 23, wherein said hydraulic circuit comprises:

(a) a tank containing the working fluid;

(b) a hydraulic pump for supplying the working fluid to said hydraulic circuit;

(c) hydraulic cylinders for extending or contracting said stretchable boom;

(d) hydraulic cylinders for varying the inclination of said stretchable boom:

(e) hydraulic cylinders for varying the angle between said stretchable boom and said platform;

(f) a first selector valve for selectively supplying the working fluid to said hydraulic cylinders, for vertically moving said platform;

(g) a second selector valve for supplying the working fluid to said hydraulic cylinders, for horizontaly moving said platform;

(h) solenoid valves for regulting the operation of said hydraulic cylinders; and (i) piping properly interconnecting the components of said hydraulic circuit.

25. A lifting apparatus according to claim 24, wherein said solenoid valves are ON-OFF solenoid valves, and said selector valves are electromagnetic three-position selector valves.

26. A lifting apparatus according to claim 23, wherein said control circuit comprises:

(a) an arithmetic data processing unit;

(b) a read-only memory for storing predetermined conrol programs and constants;

(c) a random access memory for storing control programs to be executed and variables;

(d) a digital signal input-output device;

(e) a digital signal output device electrically connected to said solenoid valves, said first selector vale and said second selector valve to control the operation of the same;

(f) an anlalog-to-digital converter connected to said inclination detector;

(g) a counter connected to said extension detecting unit and to said digital input-output device;

(h) an interrupt device which receives interrupt signals;

(i) a control box having a control lever capable of being thrown to either one of four conrol positions, namely, an UP-position, a DOWN-position, a FORWARD-position, a BACKWARD-position and a STOP-position, electrically connected to said interrput input device;

(j) an automatic control board having a MEMORY button for storing a desired position of said platform, a MODE button for selecting the mode of operation of the hudraulic circuit an AUTOMATIC UP button for actuating said hydraulic circuit for automatic platform raising operation and an AUTOMATIC DOWN button for actuating said hydraulic circuit for automatic platform lowering operation;

(k) bus lines properly interconnecting the components of said control circuit.

27. A lifting apparatus according to claim 23, wherein said control circuit calculates in raising or lowering said platform vertically with respect to and directly above said mobile vehicle, the horizontal center distance between the pins pivotally joining said strechable boom to said mobile vehicle and said platform, respectively, by an expression: $A = Ln \cdot \cos \theta n$, where Ln is the center distance between the pins corresponding to the detection signal of said extension detection unit, and $\theta n$ is the inclination of said stretchable boom corresponding to the detection signal of said inclination detector, and then said control circuit controls said hydraulic circuit according to the detection signals of the extension detecting unit and said inclination detector so that the difference between the calculated value A and a fixed value C corresponding to the center distance between the pins pivotally joining said stretchable boom to said mobile vehicle and said plaform, respectively, when said stretchable boom is fully contracted, is always smaller than a predetermined value and so that said platform is always held in parallel to the upper surface of the deck of said mobile vehicle;

said control circuit calculates, in horizontal shifting said platform on an elevated level, the vertical center distance between the pins pivotally joining said stretchable boom to said mobile vehicle and said platform, by an expression $B=Ln \cdot \sin \theta n$, where Ln is the center distance between the pins corresponding to the detection signal of the extension detecting unit, and $\theta n$ is the inclination of said stretchable boom corresponding to the detection signal of said inclination detector, and then said conrol circuit controls said hydraulic circuit so that the difference between the calculated value B and the height Ho of the elevated level is always smaller than a predetermined value and so that said platform is always held in parallel to the upper surface of the deck of said mobile vehicle, and said control circuit calculates, in obliquely raising or lowering said platform, a requisite inclination of the stretchable boom by an expression: $\theta A=\tan^{-1}\{Ho/(C+lo)\}$, where $\theta A$ is the requisite inclination, Ho is the recorded height of the oblique position, C is a fixed value corresponding to the center distance between the pins pivotally joining said stretchable boom to said mobile vehicle and said platform as said stretchable boom is fully contracted, and lo is the recorded extension of said stretchable boom from the original position, actuates said hydralic circuit to turn said stretchable boom at the inclination $\theta A$, then calculates the necessary center distance between the pins by an expression: $LA=\sqrt{(C+lo)^2+Ho^2}$, and then controls said hydraulic circuit to increase the center distance between the pins to the calculated center distance LA and to hold the platform in parallel to the upper surface of the deck of said mobile vehicle during the movement of said platform.

28. lifting apparatus according to claim 23, wherein said extension detecting unit comprises:

(a) a base fixed to the uppermost boom;

(b) a rotary shaft rotatably supported on said base;

(c) a tape fixed at one end to said rotary shaft and at the other end to said lowermost boom, and wound on said rotary shaft so as to be extended and retracted as said stretchable boom is extended and contracted, respectively;

(d) a digital encoder coupled with said rotary shaft and electrically connected to said counter of said control circuit; and (e) a cover covering said rotary shaft and said digital encoder.

29. A lifting apparatus according to claim 23, wherein said inclination detector is a potentiometer.

* * * * *